US009862562B2

(12) United States Patent
Butterworth

(10) Patent No.: US 9,862,562 B2
(45) Date of Patent: Jan. 9, 2018

(54) WEB HANDLING ROLL WITH MOVABLE VACUUM PORTS AND METHODS

(71) Applicant: Tad T. Butterworth, Ashland, WI (US)

(72) Inventor: Tad T. Butterworth, Ashland, WI (US)

(73) Assignee: C.G. Bretting Manufacturing Co., Inc., Ashland, WI (US)

( * ) Notice: Subject to any disclaimer, the term of this patent is extended or adjusted under 35 U.S.C. 154(b) by 150 days.

(21) Appl. No.: 14/737,216

(22) Filed: Jun. 11, 2015

(65) Prior Publication Data

US 2015/0360901 A1 Dec. 17, 2015
US 2017/0152123 A9 Jun. 1, 2017

Related U.S. Application Data

(60) Provisional application No. 62/012,057, filed on Jun. 13, 2014.

(51) Int. Cl.
*B65H 45/24* (2006.01)

(52) U.S. Cl.
CPC ..... *B65H 45/24* (2013.01)

(58) Field of Classification Search
CPC . B26D 1/36; B26D 7/018; B26D 7/14; B65H 45/20; B65H 45/24; B65H 2301/17; B65H 2406/33; B65H 2701/1924
See application file for complete search history.

(56) References Cited

U.S. PATENT DOCUMENTS

| | | | | |
|---|---|---|---|---|
| 1,595,992 | A | 8/1926 | Cannard et al. | |
| 3,870,292 | A * | 3/1975 | Bradley | B65H 45/165 493/353 |
| 4,279,411 | A * | 7/1981 | Nystrand | B65H 45/24 270/39.07 |
| 7,452,321 | B2 | 11/2008 | Kauppila | |
| 7,458,927 | B2 * | 12/2008 | Kauppila | B65H 45/24 270/32 |
| 7,717,839 | B2 | 5/2010 | Butterworth | |
| 7,975,584 | B2 * | 7/2011 | McCabe | A61F 13/15723 53/462 |
| 8,123,665 | B2 | 2/2012 | De Matteis | |
| 2005/0070415 | A1 * | 3/2005 | Haasl | B65H 45/164 493/424 |
| 2007/0161487 | A1 | 7/2007 | Ryczek et al. | |
| 2012/0190524 | A1 | 7/2012 | Butterworth et al. | |
| 2013/0296153 | A1 | 11/2013 | Walsh et al. | |
| 2013/0316888 | A1 * | 11/2013 | Hsu | B31F 7/00 493/360 |
| 2015/0360901 | A1 * | 12/2015 | Butterworth | B65H 45/24 493/360 |

FOREIGN PATENT DOCUMENTS

| | | | |
|---|---|---|---|
| GB | 2084965 | A | 4/1982 |
| JP | 2003251594 | A * | 9/2003 |

* cited by examiner

*Primary Examiner* — Patrick H MacKey
(74) *Attorney, Agent, or Firm* — Reinhart Boerner Van Deuren P.C.

(57) ABSTRACT

Folding machines and methods are provided. A folding machine that utilizes a direct transfer of sheets from a knife roll to a folding roll is provided. Sheet handling rolls are provided that incorporate movable vacuum ports to assist in transfer of a sheet from one roll to another roll.

16 Claims, 20 Drawing Sheets

WEB HANDLING ROLL WITH MOVABLE VACUUM PORTS AND METHODS

FIELD OF THE INVENTION

This invention generally relates to machines for folding sheets of a web of material.

BACKGROUND OF THE INVENTION

Machines for folding sheets of material are used to form stacks of folded product such as napkins, facial tissues, hand wipes, etc. The folded sheets may be interfolded such that when a stack is placed in a dispenser, when one sheet is removed a panel of the next sheet to be used is automatically extracted from the dispenser so that it can be grasped by a user.

To provide this interfolded arrangement, consecutive sheets must be overlapped as they are folded. Historically, this was done by supply two sheet streams formed by separate cutting arrangement that were out of phase equal to the desired amount of overlap. Unfortunately, these systems were extremely complex and required redundant components such as multiple cutting arrangements.

The complexity of the systems and multiple rolls in the system increased costs for the machines and maintenance as well as increased the opportunity for breakdowns. Further, the large number of rolls through which the sheets would travel could affect surface features of the sheets such as embossing.

The present invention relates to improvements over the current state of the art in folding machines and particularly in folding machines for interfolding adjacent sheets within a stack of product.

BRIEF SUMMARY OF THE INVENTION

In one aspect, the invention provides a folding machine comprising a cutting arrangement and a folding arrangement. The cutting arrangement includes a knife roll receiving a continuous web of material. The cutting arrangement is configured to sever the continuous web of material into a stream of individual sheets. The folding arrangement includes a first folding roll and a second folding roll adjacent the first folding roll. The first and second folding rolls being counter rotating and forming a folding nip therebetween. The first and second folding rolls configured to fold the sheets into a plurality of panels connected by at least one fold. The knife roll and the first folding roll forming a transfer nip therebetween with the sheets being directly transferred from the knife roll to the first folding roll.

In one embodiment, the knife roll has a knife roll peripheral speed that is greater rate than a first folding roll peripheral speed to allow for an overlap of adjacent sheets.

In one embodiment, the cutting arrangement and the folding arrangement are configured to switch between a three panel mode and a four panel mode. In the three panel mode, each sheet is formed with three panels interconnected by two folds. In the four panel mode, each sheet is formed with four panels interconnected by three folds. Typically, the machine will be configured to form panels all having the same length such that the four panel sheet is longer than the three panel sheet.

In one embodiment, the cutting arrangement and the folding arrangement are configured to switch between the three panel mode and the four panel mode by adjusting a ratio between the knife roll peripheral speed and the first folding roll peripheral speed.

In one embodiment, the cutting arrangement and the folding arrangement are configured to switch between the three panel mode and the four panel mode by changing a number of knife blades of the knife roll that are active.

In one embodiment, the knife roll rotates about a knife roll axis of rotation. The knife roll has a knife roll maximum radius defined by a maximum radial position of a knife roll component of the knife roll relative to the knife roll axis of rotation. The knife roll maximum radius defines a circular knife roll operating zone. The first folding roll rotates about a first folding roll axis of rotation. The first folding roll has a first folding roll maximum radius defined by a maximum radial position of a first folding roll component of the first folding roll relative to the first folding roll axis of rotation. The first folding roll maximum radius defining a circular first folding roll operating zone. In one embodiment, these zones overlap.

In a particular embodiment, the first and second folding rolls are vacuum folding rolls including vacuum folding ports for forming the folds in the sheets. In other embodiments, the folding rolls use mechanical tuckers and grippers to form the folds in the sheets.

In one embodiment, the circular knife roll operating zone does not overlap with the circular first folding roll operating zone.

In one embodiment, the distance between the knife roll axis of rotation and the first folding roll axis of rotation is greater than the sum of the knife roll maximum radius and the first folding roll maximum radius.

In one embodiment, the knife roll operating zone overlaps with the first folding roll operating zone proximate the transfer nip defining an overlap zone.

In one embodiment, the knife roll component is movably carried by a knife roll body of the knife roll. The knife roll component is movable sufficiently radially inward such that it avoids contact with the first folding roll component as the knife roll component transitions from an upstream side of the transfer nip to a downstream side of the transfer nip.

In one embodiment, the knife roll component is movably carried by a knife roll body of the knife roll. The knife roll component is movable to an inner radial position defining a knife roll reduced radius that is smaller than the knife roll maximum radius and less than the difference between the distance between the knife roll axis of rotation and the first folding roll axis of rotation and the first folding roll maximum radius.

In one embodiment, the knife roll component is a movable vacuum port positioned adjacent a knife blade carried by the knife roll body.

In one embodiment, the movable vacuum port is located on a trailing side of the knife blade and is configured to hold a leading end of a sheet as the leading end of the sheet is carried by the knife roll toward the transfer nip.

In one embodiment, a cam arrangement is operably cooperates with a knife roll component. The cam arrangement is configured to actuate the knife roll component radially inward prior to passing through the transfer nip and actuate the knife roll component radially outward after passing through the transfer nip.

In one embodiment, the movable vacuum port is rotatably carried by the knife roll body.

In one embodiment, the movable vacuum port transitions radially outward as the movable vacuum port approaches the transfer nip while holding the leading end of the sheet to the knife roll and then transitions radially inward after the leading end of the sheet is transferred to the first folding roll.

In one embodiment, the movable vacuum port transitions radially outward after the leading end of the sheet is transferred to the first folding roll and then transfers radially inward prior to holding the leading end of a next sheet.

In one embodiment, the movable vacuum port is rotatably carried by the knife roll body for rotation about a movable vacuum port axis of rotation. The movable vacuum port is movable between a first position and a second position. The movable vacuum port being closer to the knife blade in the first position than in the second position.

In one embodiment, the maximum radial position from the knife roll axis of rotation of the knife roll component is at an intermediate position between the first and second positions.

In one embodiment, the vacuum port transitions from the first position to the second position as the leading end of the sheet is transferred from the knife roll to the folding roll.

In one embodiment, the vacuum port transitions from the second position to the first position after the leading end of the sheet is transferred from the knife roll to the folding roll.

In one embodiment, the knife roll body rotates about the knife roll body of rotation in a first direction during operation and the movable vacuum port rotates about the movable vacuum port axis of rotation in a second direction opposite the first direction when transitioning from the first position to the second position.

In one embodiment, the knife roll includes a second vacuum port positioned to hold an upstream portion of the sheet that is spaced from the leading end of the sheet. The transition of the movable vacuum port from the first position to the second position causes a bubble to begin to form in a portion of the sheet between the movable vacuum port and the second vacuum port.

In one embodiment, the first folding roll component is movably carried by a first folding roll body of the first folding roll. The first folding roll component is movable sufficiently radially inward such that it avoids contact with the knife roll component as the first folding roll component transitions from an upstream side of the transfer nip to a downstream side of the transfer nip.

In one embodiment, the first folding roll component is movably carried by a first folding roll body of the first folding roll. The first folding roll component is movable to an inner radial position defining a first folding roll reduced radius that is smaller than the first folding roll maximum radius and less than the difference between the distance between the knife roll axis of rotation and the first folding roll axis of rotation and the knife roll maximum radius.

In one embodiment, the first folding roll component is a retractable mechanical gripper.

In one embodiment, the first folding roll component is a retractable mechanical tucker.

In one embodiment, a method of folding a plurality of sheets formed from a single web of material using a folding machine including a cutting arrangement including a knife roll and a folding arrangement including a first folding roll and a second folding roll is provided. The method includes severing the single web of material into a plurality of sheets using the cutting arrangement. The method includes transferring the sheets from the knife roll directly to the first folding roll. The method includes folding the sheets using the first and second folding rolls.

In one method, the method includes overlapping adjacent sheets while transferring the sheets from the knife roll to the folding roll.

In one method, overlapping adjacent sheets includes driving the knife roll and the first folding roll at different peripheral speeds.

In one method, the step of transferring the sheets includes transferring the sheets using a movable vacuum port.

In one embodiment, a web handling roll arrangement is provided. The web handling roll arrangement could be, e.g., a knife roll, a folding roll, a lap roll, a transfer roll, etc. The web handling roll arrangement includes a roll body and movable vacuum port member. The roll body defines a roll body axis of rotation. The movable vacuum port member is carried by the roll body. The movable vacuum port member includes a first vacuum port being configured to provide a vacuum for adhering a web of material to the roll body as the roll body rotates about the roll body axis of rotation. The movable vacuum port member is movable relative to the roll body to transition the first vacuum port between first and second positions relative to the roll body.

In one embodiment, the first and second positions are at different radial locations relative to the roll body axis of rotation.

In one embodiment, the first and second positions are at different angular locations about the roll body axis of rotation.

In one embodiment, the movable vacuum port member is rotatably carried by the roll body for rotation about a movable vacuum port member axis of rotation relative to the roll body.

In one embodiment, the roll handling body is configured to rotate about the roll body axis of rotation in a first angular direction and the movable vacuum port member is configured to rotate, at least in part, in a second angular direction about the movable vacuum port member axis of rotation that is opposite the first angular direction. The axes of rotation being generally parallel to one another.

In one embodiment, a cam arrangement is included for actuating the movable vacuum port member between the first and second positions.

In one embodiment, the web handling roll arrangement includes a vacuum supply manifold positioned within the roll body. A vacuum supply valve arrangement is interposed between the vacuum supply manifold and the movable vacuum port member.

In one embodiment, movement of the movable vacuum port member relative to the roll body transitions the vacuum supply valve between open (on) and closed (off) states.

In one embodiment, the vacuum supply valve includes first and second sliding surfaces that each have openings. When the openings fluidly communicate, the vacuum supply valve is in the open state. When the openings do not fluidly communicate, the vacuum supply valve is in the closed state.

In one embodiment, the first and second surfaces are generally curved and the first and second surfaces rotate relative to one another about a valve axis of rotation that is offset radially from the roll body axis of rotation.

In one embodiment, the valve axis of rotation is parallel to the roll body axis of rotation and is coaxial with the movable vacuum port member axis of rotation.

In one embodiment, the vacuum supply manifold remains continuously under vacuum at all angular positions of the roll body about the roll body axis of rotation. In some embodiments, the vacuum supply manifold need not be transitioned to atmospheric pressure during operating cycles.

In one embodiment, the vacuum supply manifold is radially offset from the roll body axis of rotation.

In one embodiment, when the movable vacuum port member moves to transition the first vacuum port between the first and second positions relative to the roll body, the first vacuum port passes through a third position having a different radial position than at least one of the first and second position.

In one embodiment, the third position is radially further from the roll body axis of rotation than the first and second positions such that as the movable vacuum port member moves to transition the first vacuum port from the first position to the second position the first vacuum port first moves radially outward as the first vacuum port approaches the third position and then moves radially inward as the first vacuum port moves away from the third position to the second position.

In one embodiment, a second vacuum port is spaced angularly from the first vacuum port.

In one embodiment, when the first vacuum port moves from the first position toward the second position, the first vacuum port moves towards the second vacuum port.

In one embodiment, the first vacuum port is configured to hold a leading end of the web and the second vacuum port is configured to hold a trailing portion of the web, e.g. a portion upstream from the leading end of the web.

In one embodiment, a second vacuum port is spaced angularly from the first vacuum port. A second vacuum supply manifold is positioned within the roll body. A second vacuum supply valve arrangement interposed between the second vacuum supply manifold and the second vacuum port to control vacuum supplied to the second vacuum port.

In one embodiment, the roll body axis of rotation passes through second vacuum supply manifold.

In one embodiment, the first vacuum port is configured to hold a leading end of a web and the second vacuum port is configured to hold a trailing portion of the web.

In one embodiment, the second vacuum supply manifold and second vacuum supply valve are formed by a tube-in-a-tube arrangement.

In one embodiment, a second roll body defining a second roll body axis of rotation is provided. A third vacuum port is provided. The first and second roll bodies define a transfer nip therebetween proximate which, at a least a portion of, a web of material is transferred from the first roll body to the second roll body. The web of material is transferred proximate the transfer nip from the first vacuum port to the third vacuum port.

In one embodiment, the movable vacuum member moves relative to the first roll body during the transfer of the web from the first vacuum port to the third vacuum port.

In one embodiment, the first and second roll bodies are counter-rotating during normal operation.

In one embodiment, the first roll body rotates with a first peripheral speed and the second roll body rotates with a second peripheral speed different than the first peripheral speed. The first vacuum port moves relative to the first roll body during transfer of the web to reduce a difference in speed between the first vacuum port and the third vacuum port during transfer of the web from the first roll body to the second roll body.

In one embodiment, the first peripheral speed is greater than the second peripheral speed and the first vacuum port moves relative to the first roll body in an opposite direction as the first roll body during transfer of the web from the first vacuum port to the third vacuum port.

In one embodiment, the first and third vacuum ports have speeds that are within 10% of each other during transfer of the web from the first vacuum port to the third vacuum port.

In one embodiment, the first and third vacuum ports have speeds that are within 5% of each other during transfer of the web from the first vacuum port to the third vacuum port.

In one embodiment, the first and third vacuum ports have speeds that are within 1% of each other during transfer of the web from the first vacuum port to the third vacuum port.

In one embodiment, the second roll body carries a web handling component that protrudes radially beyond an outer surface of the second roll body proximate the third vacuum port and the first movable vacuum port member protrudes radially beyond an outer surface of the first roll body. The first movable vacuum port member is moved during transfer of the web from the first vacuum port to the third vacuum port such that the first movable vacuum port member does not contact the web handling component.

In one embodiment, the first vacuum port holds a leading end of the web and transfers the leading end of the web to the third vacuum port. The leading end of the web is positioned proximate the web handling component carried by the second roll body after transfer.

In one embodiment, the leading end of the web is no more than one inch from the web handling component carried by the second roll body after transfer.

In one embodiment, the leading end of the web is no more than one-quarter inch from the web handling component carried by the second roll body after transfer.

In one embodiment, the leading end of the web contacts the web handling component carried by the second roll body after transfer.

In one embodiment, the first roll body carries a first web handling component different than the first movable vacuum port member. The first web handling component protrudes radially beyond an outer surface of the first roll body. The first web handling component defines a first radius between an outermost portion of the first web handling component and the first roll body axis of rotation. The first movable vacuum port member protrudes radially beyond an outer surface of the first roll body. The first moveable vacuum port member defines a movable vacuum port radius between an outermost portion of the first movable vacuum port member and the first roll body axis of rotation. The second roll body carries a second web handling component that protrudes radially beyond an outer surface of the second roll body proximate the third vacuum port. The second web handling component defines a second radius between an outermost portion of the second web handling component and the second roll body axis of rotation.

In one embodiment, during at least some portion of the transfer from the first vacuum port to the third vacuum port, the movable vacuum port radius is greater than the first radius and the sum of the second radius and the movable vacuum port radius is greater than a distance between the first and second roll body axes of rotation.

In one embodiment, the second radius defines a circular operational zone boundary and during, at least a portion of, the transfer, the movable vacuum port member penetrates the circular operational zone boundary.

In one embodiment, the first web handling component is a knife blade and the second web handling component is a tucker or a gripper.

In one embodiment, the sum of the first and second radii is less than a distance between the first and second roll body axes of rotation.

In one embodiment, the first and second roll bodies are configured to transfer a stream of sheets from the first roll body to the second roll body with adjacent sheets in the stream overlapped when held by the second roll body.

In one embodiment, the second roll body is part of a folding arrangement and all sheets processed by the folding arrangement are cut from a single continuous web by a cutting arrangement of which the first roll body is a component thereof.

In one embodiment, a method of transferring a sheet of a web of material from a first web handling roll to a second web handling roll is provided. The method includes driving a first roll body of the first web handling roll at a first peripheral speed; driving a second roll body of the second web handling roll at a second peripheral speed different than the first peripheral speed creating a speed difference therebetween; holding a leading end of a sheet of a web of material with a first vacuum port of the first web handling roll; transferring the leading end of the sheet from the first vacuum port to a second vacuum port of the second web handling roll proximate a transfer nip formed between the first and second web handling rolls; and moving at least one of the first or second vacuum ports relative to the corresponding one of the first and second roll bodies while transferring the leading end of the sheet from the first vacuum port to the second vacuum port to reduce the speed difference.

In one method, the step of moving the at least one of the first or second vacuum ports makes the speed difference zero.

In one embodiment, a method of transferring a sheet of a web of material from a first web handling roll to a second web handling roll is provided. The method includes driving the first web handling roll at a first peripheral speed; driving the second web handling roll at a second peripheral speed different than the first peripheral speed creating a speed difference therebetween; holding a leading end of a sheet of a web of material with a movable vacuum port of a movable vacuum port member carried by a first roll body of the first web handling roll; transferring the leading end of the sheet from the movable vacuum port to a second vacuum port that is part of the second web handling roll proximate a transfer nip formed between the first and second web handling rolls; and moving the movable vacuum port member relative to the first roll body while transferring the leading end of the sheet from the movable vacuum port to the second vacuum port to reduce the speed difference between the first and second web handling rolls while the leading end of the sheet is transferred therebetween.

In one method, the first peripheral speed is greater than the second peripheral speed; and moving the movable vacuum port includes moving the vacuum port in an opposite direction as the first roll body.

In one method, moving the movable vacuum port includes rotating the movable vacuum port member relative to the first roll body about a movable vacuum port axis of rotation.

In one method, moving the movable vacuum port member also controls turning on and off vacuum to the movable vacuum port.

In one embodiment, a knife roll arrangement including a roll body and first and second sets of knife blades. The roll body is configured to rotate about a roll body axis of rotation. The first set of knife blades is carried by the roll body angularly spaced about the roll body axis of rotation to form a stream of first sheets. The first sheets having a first length. The first set may be a single knife blade. The second set of knife blades is carried by the roll body angularly spaced about the roll body axis of rotation to form a stream of second sheets. The second sheets have a second length different than the first length.

In one embodiment, one of the knife blades in the first set of knife blades also forms part of the second set of knife blades.

In one embodiment, at least one of the knife blades from each of the first and second sets of knife blades is a movable knife blade that is movable between an active position and an inactive position. In the active position, the knife blade is positioned such that the knife blade can cut a web of material carried on an outer periphery of the roll body. In the inactive position, the knife blade is positioned such that it cannot cut the web of material carried on an outer periphery of the roll body. Preferably, the knife blade in the inactive position is recessed below a roll body surface.

In one embodiment, a knife actuation arrangement is configured to transition the movable knife blades between the active and inactive positions.

In one embodiment, the knife actuation arrangement is configured to automatically transition the movable knife blades between the active and inactive positions.

In one embodiment, the knife actuation arrangement includes at least one linear actuator operably coupled to the knife blade to transition the movable knife blades between the active and inactive positions.

In one embodiment, the knife actuation arrangement is configured to lock the active knife blades in the active position until being changed to a different operating mode.

In one embodiment, a knife roll arrangement including a roll body, a plurality of knife blade mounting locations and first and second sets of knife blades is provided. The roll body is configured to rotate about a roll body axis of rotation. The knife blade mounting locations are angularly spaced about the roll body axis of rotation. Each knife blade mounting location is configured to mount a knife blade thereto for cutting a web of material into a plurality of sheets of material. The plurality of knife blade mounting locations include a first set of knife blade mounting locations equally angularly spaced about the roll body axis of rotation a first angular amount and positioned at locations such that when knife blades are mounted in the first set of knife blade mounting locations the web of material can be cut into a stream of first sheets. The first sheets having a first length. It should be noted that the first set of knife blade mounting locations could include a single knife blade mounting location and the angular spacing would thus be generally three hundred and sixty degrees. The second set of knife blade mounting locations equally angularly spaced about the roll body axis of rotation a second angular amount, different than the first angular amount and positioned at locations such that when knife blades are mounted in the second set of knife blade mounting locations, the web of material can be cut into a stream of second sheets. The second sheets having a second length different than the first length.

In one embodiment, the knife roll arrangement is manually transitioned between operating with blades mounted to the first set of knife blade mounting locations and operating with blades mounted to the second set of knife blade mounting locations.

In one embodiment, one of the knife blade mounting locations in the first set of knife blade mounting locations also forms part of the second set of knife blade mounting locations.

In one embodiment, an interfolding machine for interfolding a plurality of sheets formed from a single web of material is provided. The interfolding machine includes a knife roll arrangement as described herein and a folding arrangement. The folding arrangement includes a first folding roll and a second folding roll adjacent the first folding roll. The first and second folding rolls are counter rotating and forming a folding nip therebetween. The first and second folding rolls are configured to fold overlapped sheets into a plurality of panels connected by at least one fold, the sheets being cut from the web by the knife roll arrangement.

In one embodiment, the knife roll and the first folding roll form a transfer nip therebetween. The sheets are directly transferred from the knife roll to the first folding roll.

In one embodiment, the transfer of sheets from the knife roll to the first folding roll causes adjacent sheets to overlap.

In one embodiment, the knife roll rotates at a knife roll peripheral speed that is greater than a folding roll peripheral speed of the first and second folding rolls.

In one embodiment, a lap roll is positioned adjacent the knife roll and the first folding roll. The lap roll and knife roll form a lap-knife nip therebetween where sheets are transferred from the knife roll to the lap roll and proximate which the sheets are overlapped during the transfer. The lap roll and first folding roll form a lap-folding roll nip therebetween. The overlapped sheets are transferred from the lap roll to the folding first folding roll.

In one embodiment, the lap roll has a lap roll peripheral speed that is less than a knife roll peripheral speed.

In one embodiment, the first folding roll has a first folding roll peripheral speed that is equal to the lap roll peripheral speed.

In one embodiment, a lap roll adjacent the knife roll and the first folding roll. The lap roll and knife roll form a lap-knife nip therebetween where sheets are transferred from the knife roll to the lap roll. The lap roll and first folding roll form a lap-folding roll nip therebetween where the sheets are transferred from the lap roll to the folding first folding roll and proximate which the sheets are overlapped during the transfer from the lap roll to the folding roll.

In one embodiment, the lap roll has a lap roll peripheral speed that is greater than a first folding roll peripheral speed of the first folding roll.

In one embodiment, the knife roll has a knife roll peripheral speed that is equal to the lap roll peripheral speed.

In one embodiment, the folding roll is configured to form folded panels of a third length. The first length is such that sheets are cut to a length equivalent to three panels. The second length is such that sheets are cut to a length equivalent to four panels.

In one embodiment, a first servo drive arrangement for rotatably driving the knife roll body with a servo motor is provided. Also, a second servo drive arrangement for rotatably driving, at least, the first folding roll body with a servo drive motor is provided. The rotation of the knife roll body and the first roll body is mechanically independent.

In one embodiment, the interfolding machine is configured to automatically switch between a first mode for forming sheets of a first length and a second mode for forming sheets of a second length including automatically switching between the first and second sets of knife blades and automatically changing the ratio of the rotational speeds of the knife roll body and the first folding roll body.

In one embodiment, a first servo drive arrangement for rotatably driving the knife roll body with a servo motor is provided. A third servo drive arrangement for rotatably driving, at least, the lap roll with a servo drive motor is provided. The rotation of the knife roll body and the lap roll being mechanically independent.

In one embodiment, the interfolding machine is configured to automatically switch between a first mode for forming sheets of a first length and a second mode for forming sheets of a second length including automatically switching between the first and second sets of knife blades and automatically changing the ratio of the rotational speeds of the knife roll body and the lap roll.

In one embodiment, a control arrangement is configured to switch between the first and second modes.

A method of configuring a knife roll arrangement is provided. The method includes providing a roll body configured to rotate about a roll body axis of rotation; making active a first set of knife blades carried by the roll body angularly spaced about the roll body axis of rotation to form a stream of first sheets, the first sheets having a first length; and making active a second set of knife blades carried by the roll body angularly spaced about the roll body axis of rotation to form a stream of second sheets, the second sheets having a second length different than the first length. It should be noted that either of the first and second sets could have a single knife blade.

In one method, one of the knife blades in the first set of knife blades also forms part of the second set of knife blades.

On method includes deactivating at least one knife blade of the first set of knife blades prior to the step of making active the second set of knife blades.

In one method, deactivating and activating the first and second sets of knife blades occurs manually by manually removing and attaching corresponding ones of the knife blades of the first and second sets of knife blades from and to the roll body.

In one method, deactivating and activating the first and second sets of knife blades occurs automatically by automatically transitioning corresponding ones of the knife blades of the first and second sets of knife blades radially relative to the roll body.

A method of configuring a folding machine between first and second modes, in the first mode, the folding machine folds sheets of a web of material into a first folded sheet having a first number of panels, and in the second mode, the folding machine folds sheets of a web of material into a second fold sheet having a second number of panels different than the first is provided. The method includes operating in the first mode including: making active a first set of knife blades carried by a knife roll body angularly spaced about a knife roll body axis of rotation to form a stream of first sheets, the first sheets having a first length; driving the knife roll body about the knife roll body axis of rotation; driving a first folding roll body about a first folding roll body axis of rotation, such that a knife roll peripheral speed of the first knife roll body and a first folding roll peripheral speed of the first folding roll body defines a first speed ratio. The method includes operating in the second mode including: making active a second set of knife blades carried by the knife roll body angularly spaced about the knife roll body axis of rotation to form a stream of second sheets, the second sheets having a second length different than the first length; driving the knife roll body about the knife roll body axis of rotation; driving the first folding roll body about a first folding roll body axis of rotation such that the knife roll peripheral speed of the first knife roll body and the first folding roll peripheral speed of the first folding roll body defines a second speed ratio different than the first speed ratio.

In one method, the first and second speed ratios are not equal to 1.

In one method, in the first mode, the first length is equal to three panel widths and the second length is equal to four panel widths.

In one method, the first speed ratio is 3/2 and the second speed ratio is 4/2.

In one method, the steps of driving the knife roll are performed by use of a knife roll drive arrangement. The steps of driving the first roll body are performed by use of a first folding roll drive arrangement, which is not drivingly coupled to the knife roll drive arrangement such that adjustments in the knife roll drive arrangement do not necessarily adjust the first folding roll drive arrangement.

In one method, the knife roll drive arrangement and the first folding roll drive arrangement each include a servo drive motor.

In one method, the method includes automatically switching between operating in the first mode and operating in the second mode.

In one method, the method includes deactivating at least one knife blade of the first set of knife blades while operating in the second mode.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
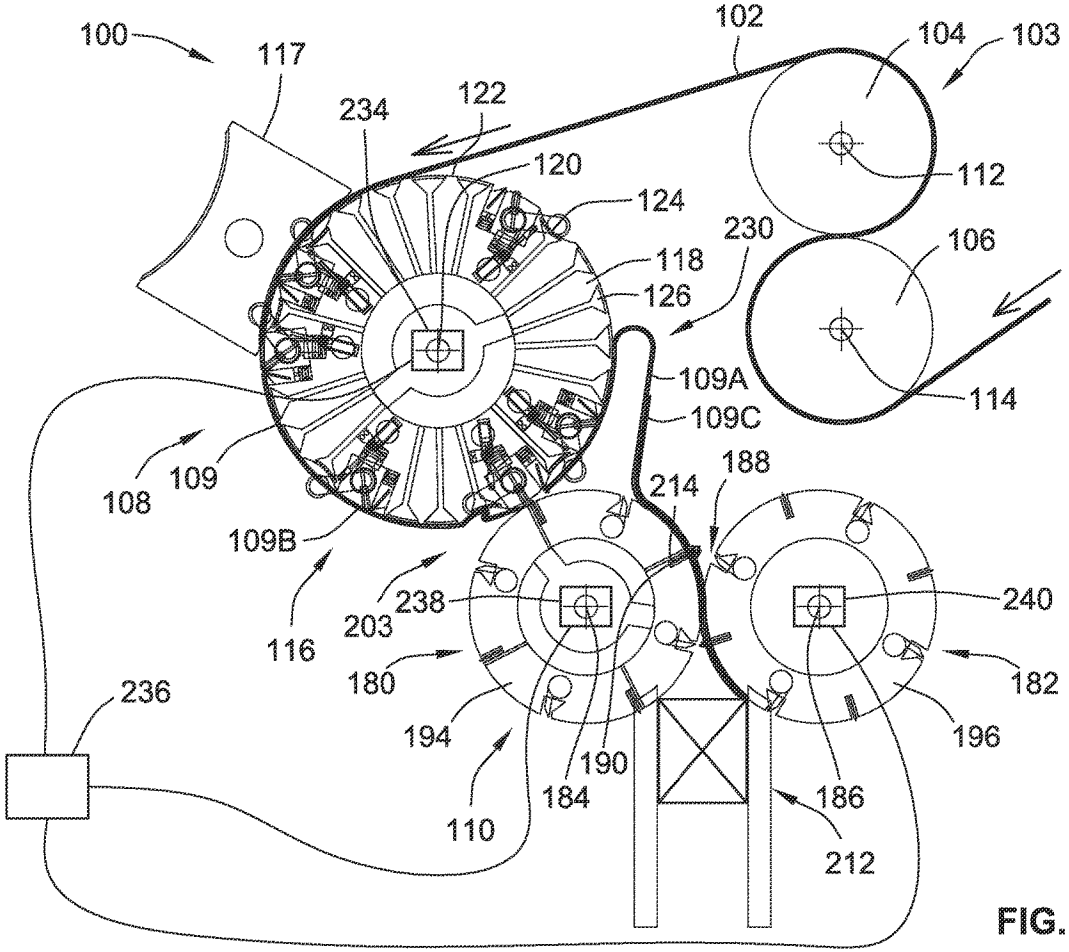
FIG. 1 is a first embodiment of a folding machine that can be changed between different modes that includes cam actuated vacuum ports.

FIG. 1 illustrates, in schematic form, a first embodiment of a folding machine 100. The folding machine 100 is configured to form a plurality of folded sheets from a single continuous web of material 102. A web supply arrangement 103 supplies the continuous web of material 102 to downstream components. A cutting arrangement 108 receives the continuous web of material 102 and operably severs the continuous web of material 102 into a stream of sheets 109. The stream of sheets 109 are then supplied to a folding arrangement 110 that folds the each sheet 109 into a plurality of panels with adjacent panels interconnected at fold lines.

Preferably, the folding arrangement 110 interfolds adjacent sheets 109 such that at least one panel of an upstream sheet is interposed between two adjacent panels of a downstream sheet 109.

As will be described more fully, the folding machine 100 may be configured to operate in different modes that form sheets of different lengths and have different numbers of panels. For instance, in one embodiment, the folding machine 100 may be configured to form, for example, in a first mode, sheets having a length equivalent to three panel widths. In a second mode, the folding machine 100 may be configured to form sheets having a length equivalent to four panel widths (the panel widths in either mode typically being the same value).

The supply 103 arrangement includes a pair of counter-rotating pull rolls 104, 106 that rotate about pull roll axes 112, 114.

The continuous web of material 102 travels from the pull rolls 104, 106 to the cutting arrangement 108. The cutting arrangement 108 generally includes a knife roll 116 that cooperates with an anvil 117 to sever the continuous web of material 102 into sheets 109.

Figure 2:
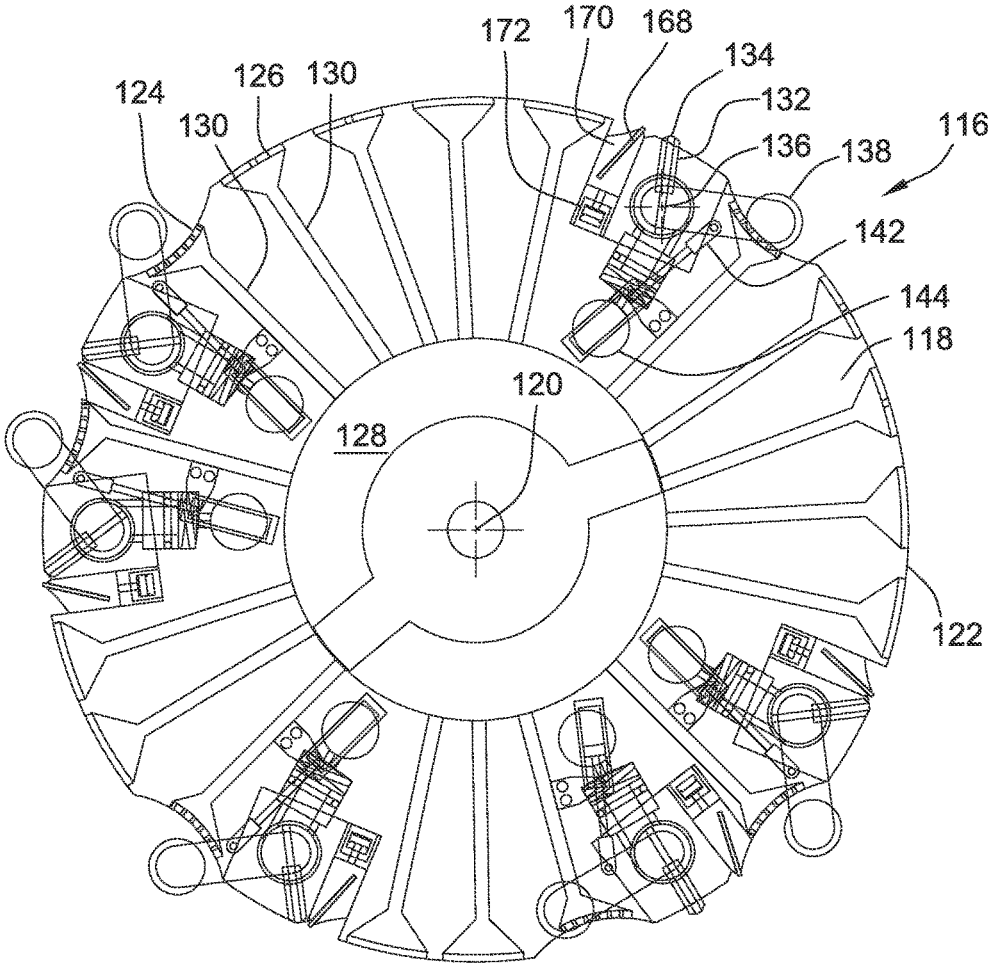
FIG. 2 is a simplified enlarged illustration of a knife roll used in the folding machine of FIG. 1.

With additional reference to FIG. 2, the knife roll 116 includes a knife roll body 118 that rotates about knife roll axis of rotation 120. The sheets 109 and the web of material 102 are carried by the knife roll 116 on, at least in part, the outer periphery 122 of the knife roll body 118.

The knife roll 116 includes a plurality of vacuum ports for holding and securing the web of material 102 and the sheets 109 to the outer periphery 122. More particularly, the knife roll 116 includes a plurality of fixed position vacuum ports 124, 126 that are provided by channels formed in the knife roll body 118. The fixed position vacuum ports 124, 126 operably communicate with a tube-in-tube style vacuum system and operably communicate with one or more vacuum chambers 128 internal to the knife roll body 118. These vacuum ports 124, 126 selectively provide vacuum at the outer periphery 122 if the corresponding connection channels 130 are in fluid communication with the vacuum chambers 128.

The illustrated fixed position vacuum ports 124, 126 flare outward when moving radially outward. The flared section provides a manifold connecting the connection channels 130 and a plurality of smaller holes formed in the outer peripheral surface of the knife roll 116. Smaller holes at the roll surface are desired to evenly distribute the vacuum holding the sheet 109 to the outer periphery 122. However, a larger diameter hole provided for the connection channels 130 provides lower flow restriction within the knife roll body 118.

The knife roll body 118 also carries a plurality of movable vacuum port members 132 that define movable vacuum ports 134. In the illustrated embodiment, the movable vacuum port members 132 are rotatably carried by the knife roll body 118 for rotation about movable vacuum port axis of rotation 136.

Figure 3:
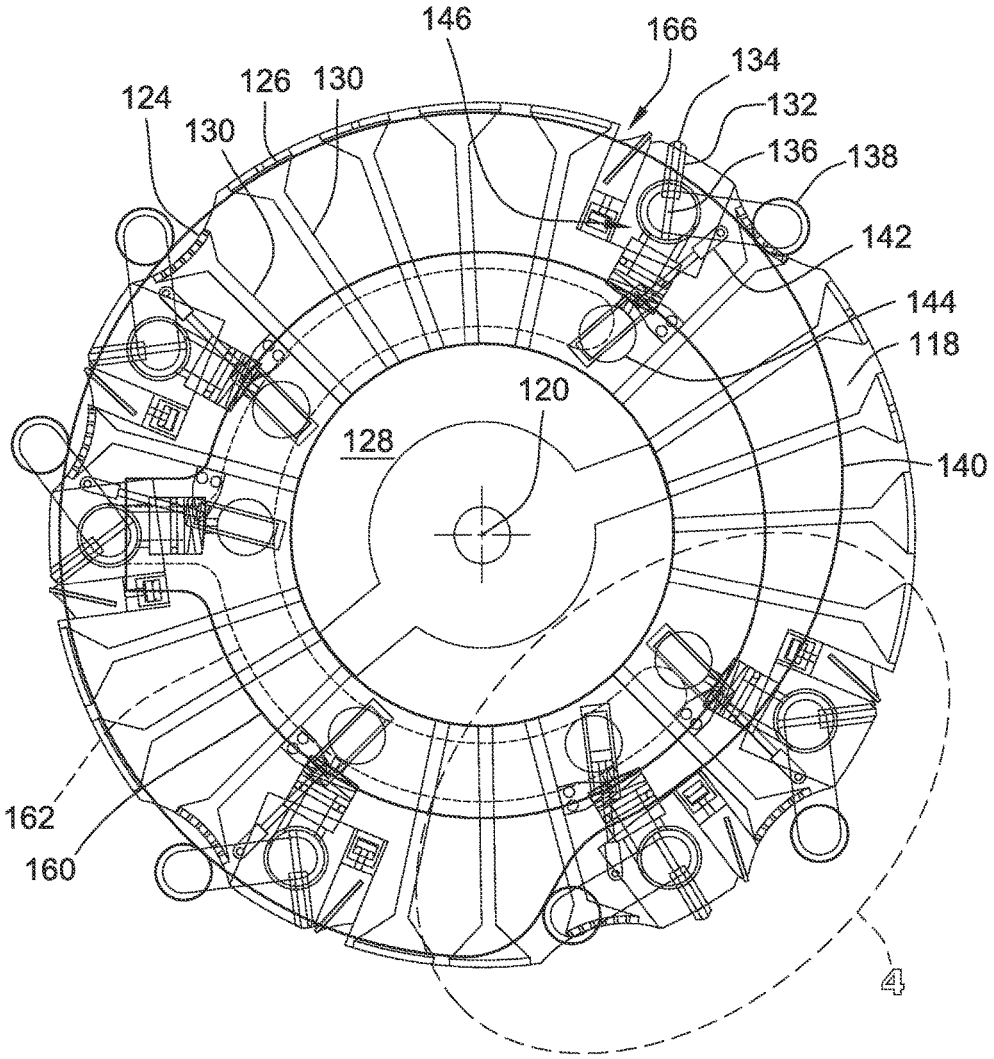
FIG. 3 is a simplified illustration of the knife roll of FIG. 2 in cooperation with a cam surface for actuating movable vacuum port members of the knife roll.

The movable vacuum port member 132 includes a cam follower arrangement 138 configured to follow a profiled cam surface 140 (see FIG. 3). The cam surface 140 is fixed in position and does not rotate with knife roll body 118.

With linear actuator 142 is coupled to the cam follower 138 and configured to selectively maintain cam follower 138 in contact with the cam surface 140. The actuator 140 can be used to lift the cam follower 138 off the cam surface 140 and transition the distal end of the movable vacuum port member 132 into a radially retracted position. Such a retracted position may be desirable when the movable vacuum port 134 is not needed or in the event of a failure in the machine or loss of power. Typically, the linear actuator 142 would be configured to automatically transition to the radially retracted position in the event of loss of power to provide fail safe operation.

While use of a cam/cam follower arrangement is illustrated, other actuation arrangements are contemplated. For instance, the movable vacuum port member 132 could be directly linearly actuated (radially or at an angle skew to radially) by a linear actuator. Further yet, rather than using the cam surface 140 to manipulate the cam follower 138, an actuator could directly manipulate the position of a structure similar to cam follower 138 to cause angular rotation of the movable vacuum port member 132 about axis of rotation 136.

Figure 4:
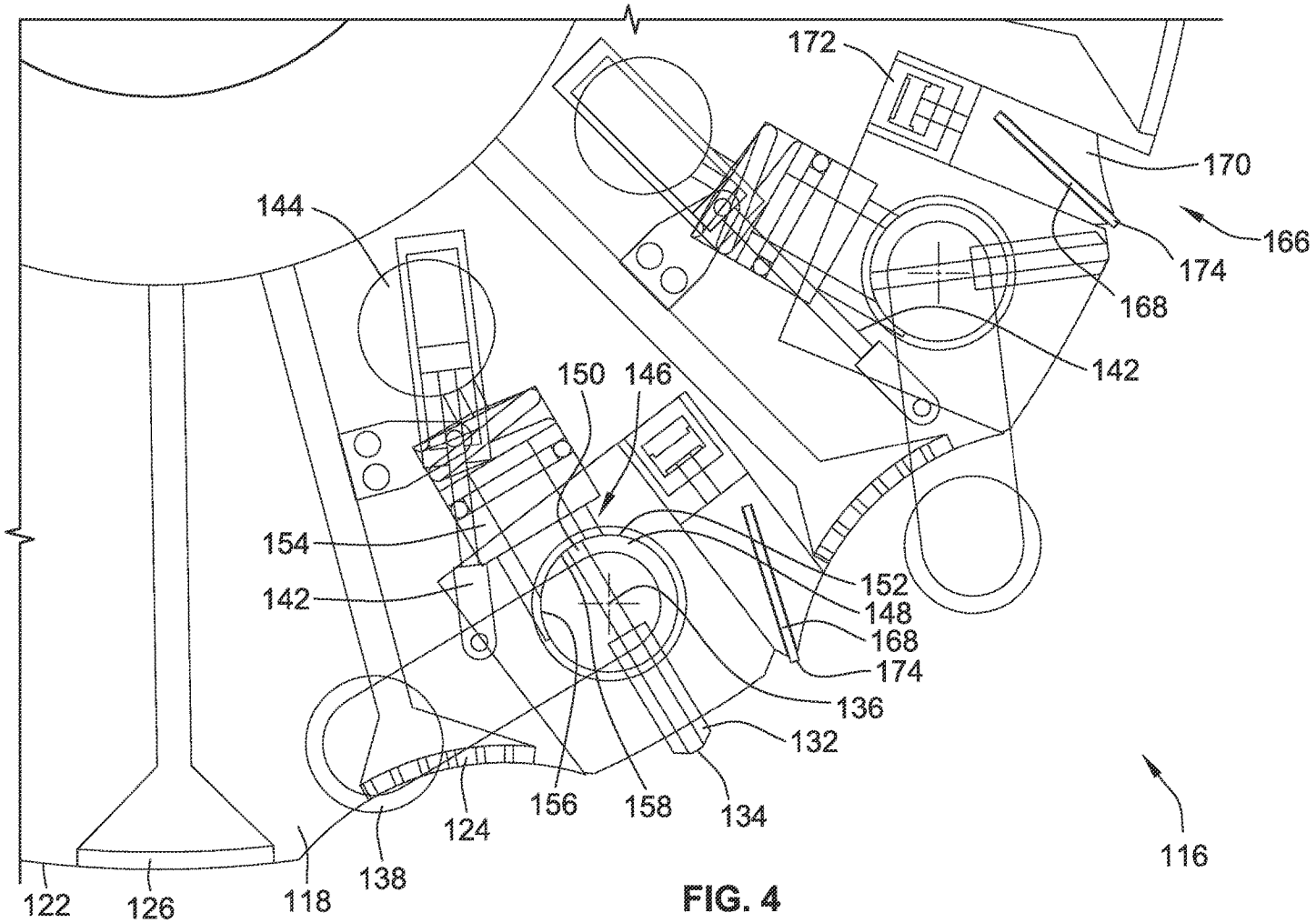
FIG. 4 is an enlarged illustration of a portion of the knife roll.

With additional reference to FIG. 4, each movable vacuum port member 132 communicates with a corresponding vacuum chamber 144 for supplying vacuum to vacuum ports 134. A valve arrangement 146 is interposed between the vacuum chamber 144 and the movable vacuum port 134 to selectively turn on and remove vacuum from the movable vacuum port 134. The movable valve port member 132 includes a pivoting body portion 148 that is coupled to the cam follower 138 and that includes an opening 150 opposite to and in fluid communication with movable vacuum port 134 in outer curved surface 152.

A spring biased seal member 154 has a concave surface 156 that mates with outer curved surface 152 to form a seal therebetween. The seal member 154 and particularly concave surface 156 defines an opening 158 that selectively communicates with opening 150 to turn on and off vacuum at movable vacuum port 134. Opening 158 in the seal member 154 is larger in dimension than opening 150 such that some degree of angular motion of the pivoting body portion 148 about axis of rotation 136 allows the two openings 150, 158 to remain in fluid communication. However, in some angular positions of the pivoting body portion 148, the two openings 150, 158 will not align preventing or significantly limiting communication between openings 150, 158 to turn off vacuum at movable vacuum port 134.

The seal member 154 is slidably carried in a corresponding cavity of the knife roll body 118. The outer surfaces of the seal member 154 within the cavity provide a seal therebetween to further facilitate the sealing connection between the movable vacuum port member 132 and the vacuum chamber 144.

This arrangement positions the location of turning on and off vacuum, e.g. by valve arrangement 146, very close to the movable vacuum port 134 which promotes significantly improved responsiveness of the control of vacuum provided by movable vacuum port 134. In some embodiments, the interface between surfaces 152 and 156 is less than 3 inches and more preferably less than 2 inches from the movable vacuum port 134.

With reference to FIG. 3, the vacuum chambers 144 extend axially through the knife roll body 118. At one or both axial ends of the knife roll body 118, the vacuum chambers 144 communicate with a fixed position vacuum supply mechanism 160 that is operably connected to an external vacuum supply mechanism. The dashed line 162 illustrates the angular zone where the vacuum supply mechanism 160, external to the knife roll body 118, is in communication with the vacuum chambers 144. Chambers 144 come into communication with the vacuum in the vacuum supply mechanism 160 from a point just prior to the web 102 contacting the knife roll 116 to a point just after transfer to the folding roll 110 is complete. Chamber 144 is not in communication with vacuum as the chamber 144 passes through the zone where no web or sheet is held to the knife roll 116. This is also the zone where the movable vacuum port 134 resets after transfer.

The vacuum supply mechanism 160, which may also be referred to as a valve due to it being configured to selectively supply and turn off vacuum to chambers 144 based on their angular orientations, is preferably manufactured from a good bearing material that rides against a hardened steel plate on the end of the knife roll body 118. This arrangement may provide a sufficient seal therebetween. However, in other embodiments, a seal, not shown, may be provided between the structure that provides the fixed position vacuum supply mechanism 160 and the knife roll body 118 to seal the vacuum chambers 144 to the vacuum supply mechanism 160 when in the zone identified by the dashed line 162.

Returning to FIG. 4, the knife roll 116 includes a plurality of knife blade mounting locations 166 where a corresponding knife blade 168 is operably mounted to the knife roll body 118. In the illustrated embodiment, each knife blade 168 is carried in a knife blade holder 170 that is slidably carried on the knife roll body 118. The knife blade holder 170 is connected to a linear actuator in the form of a cylinder 172 for radially moving the knife blade 168 inward and outward (or with some slight off radius motion).

In a radially outer position, the knife blade 168 can be used to sever the web of material 102 into sheets 109. In a radially inward position (also referred to as an inactive position or a retracted position), the knife blade will not sever the web of material. Preferably, in the retracted position, the exposed distal end 174 of the knife blade 168 is recessed below an outermost portion of outer periphery 122 of the knife roll body 118. Likewise, in the radially outward position (also referred to as an active position), the exposed distal end 174 of the knife blade 168 extends radially outward beyond, at least, the adjacent portions of the knife roll 116 and preferably radially outward beyond the outer most portion of outer periphery 122.

The movable vacuum ports 134 are used to hold a leading end of a sheet 109 as it is held by the knife roll 116 prior to transfer to the folding arrangement 110. The movable vacuum ports 134 are thus located proximate the knife blades 168 on a trailing side of the knife blades 168 relative to a normal operational direction of travel of the knife roll 116.

Figure 5:
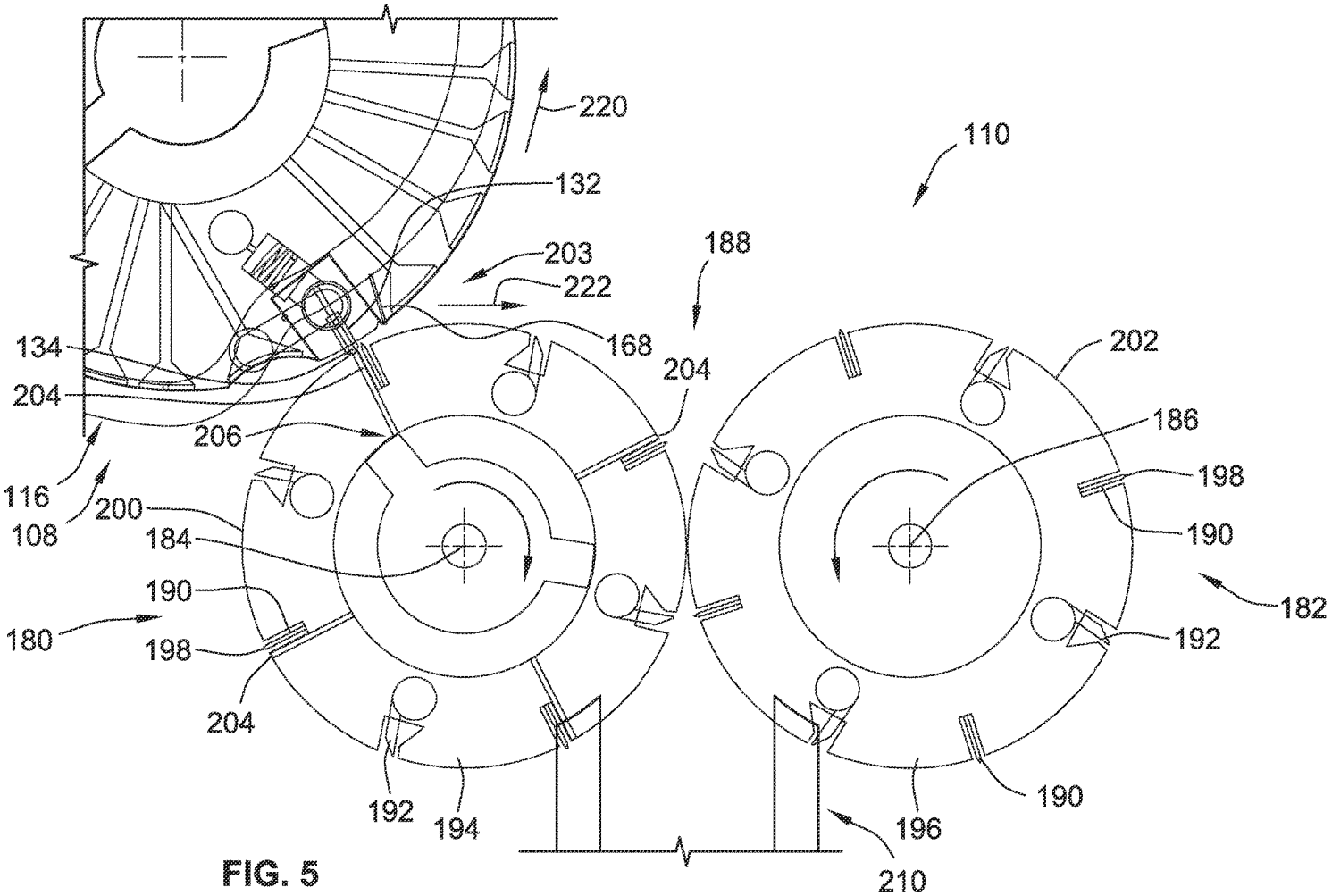
FIG. 5 is an enlarged simplified illustration of a portion of the folding machine of FIG. 1.

With reference to FIGS. 1 and 5, downstream from the cutting arrangement is the folding arrangement 110. The folding arrangement 110 generally includes first and second folding rolls 180, 182 that counter rotate about first and second folding roll axes of rotation 184, 186. The first and second folding rolls 180, 182 form a folding nip 188 therebetween.

Each folding roll 180, 182, in this embodiment, includes one or more tucker and one or more gripper 192. The tuckers 190 and grippers 192 are angularly oriented such that the tuckers 190 of one of the folding rolls 180, 182, align and mate with the grippers 192 of the other one of the folding rolls 182, 180 proximate the folding nip 188.

The tuckers 190 and grippers 192 are carried by a corresponding one of a first and second folding roll body 194, 196 of the first and second folding rolls 180, 182, respectively.

The tuckers 190 have a distal end 198 that extend radially outward beyond outer surfaces 200, 202 of the folding roll bodies 194, 196.

In the illustrated embodiment, the folding arrangement 110 is located directly adjacent to the cutting arrangement 108. More particularly, the knife roll 116 of the cutting arrangement 108 is directly adjacent the first folding roll 180 forming a transfer nip 203 therebetween.

The first folding roll 180 includes a plurality of folding roll vacuum ports 204 located adjacent to and on a trailing side of the tuckers 190. The folding roll vacuum ports 204 are used to transfer, at least, a leading end of the sheets 109 to the first folding roll 180 when the sheets 109 are transferred, directly, from the knife roll 116 to the first folding roll 180. The folding roll vacuum ports 204 communicate with a vacuum supply arrangement 206 that includes valving for selectively turning on and turning off vacuum to the folding roll vacuum ports 204. The vacuum ports may be channels formed directly into the first folding roll body 194.

Downstream from the folding arrangement 110 and particularly the folding nip 188 is a stack handling arrangement 210. The stack handling arrangement 210 receives the sheets 109 after they have been folded by the first and second folding rolls 180, 182. The stack handling arrangement 210 may be configured to separate the sheets into individual packs of sheets using various separation techniques known in the art.

Now that the general components of the folding machine 100 have been identified, the operation of this and other embodiments will be described.

With reference to FIG. 1, the folding machine 100 is configured to form a stack 212 of sheets 109 from a single web of material 102. The sheets 109 are folded to form multiple panels prior to being stacked in stack 212. The sheets 109 will typically be interfolded such that at least one panel of a sheet 109 is interposed between two panels of an adjacent downstream sheet and at least one panel of the sheet 109 is interposed between two panels of an adjacent upstream sheet.

Figure 6:
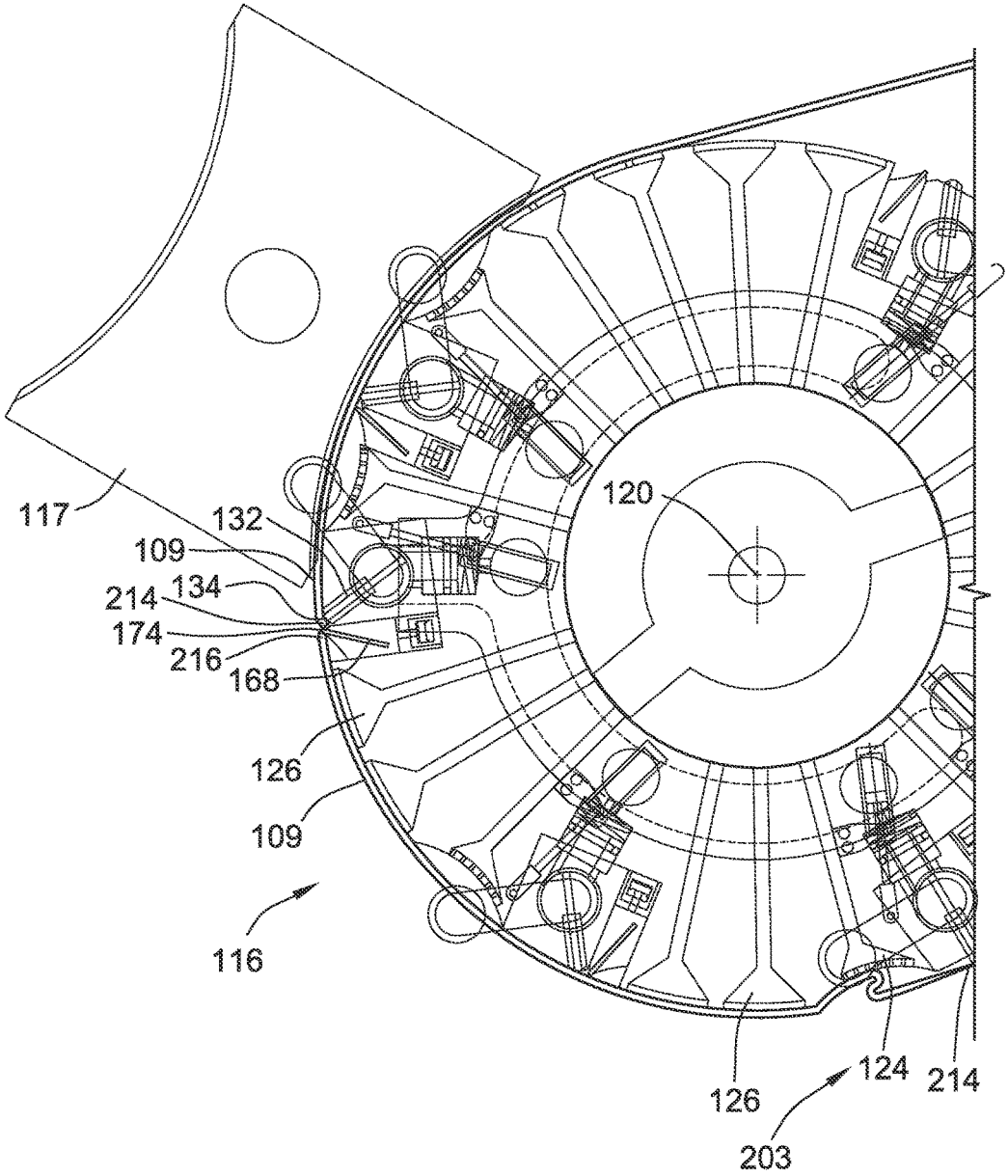
FIG. 6 is an enlarged partial illustration of the cutting arrangement of the folding machine of FIG. 1.

The web of material 102 is fed to the cutting arrangement 108 where the web of material 102 is cut into a stream of adjacent sheets 109 as the web 102 passes between anvil 117 and knife roll 116 as the web 102 is held by the knife roll 116. With additional reference to FIG. 6, the knife blades 168 will sever the web 102 to form both a leading end 214 of an upstream sheet 109 and a trailing end 216 of a downstream sheet 109. Notably, the leading end 214 remains part of the continuous web 102 until after a second cut is performed.

The sheet 109 that has just been severed from the web 102 is held to the outer periphery of the knife roll 116 by vacuum ports 124, 126, 134 as the sheet is carried towards the first folding roll 180 of the folding arrangement 110. The leading end 214 of the sheets is held by the movable vacuum ports 134 while the remainder of the sheets is held by vacuum ports 124, 126.

Prior to severing of the web 102, the movable vacuum port member 132 that will hold the leading end 214 formed at the next cut will be positioned in a first position proximate the trailing side of the knife blade 168. This allows the movable vacuum port 134 to vacuum grab the leading end 214 at, before or slightly after the time of cutting. The position of the movable vacuum port 134 is at a radially inward position compared to its maximum radially outer position relative to the knife roll axis of rotation 120.

The knife roll 116 will carry the sheets 109 toward the first folding roll 180 and the transfer nip 203 where the leading end 214 of each sheet 109 is transferred to the folding arrangement 110. This transfer from the knife roll 116 to the first folding roll 180 occurs by turning off vacuum to the movable vacuum port 134 holding the leading end 214. This releases the leading end 214 from the knife roll 116. Simultaneously, vacuum is turned on at a folding roll vacuum port 204 that is proximate the transfer nip 203. Preferably, the leading end of the sheet is transferred right at the tip of the tucker of the folding roll 180. When the leading end 214 is not at the tip of the tucker, imperfections and inconsistencies occur in the resulting stack of folded sheets exiting the folding arrangement 110. Ideally, the leading end 214 of the sheet 109 is no more than 1 inch from the tip of the tucker, more preferably no more than one-quarter of an inch from the tip of the tucker and most preferably almost exactly at the tucker tip after transfer.

However, because this embodiment utilizes a direct transfer from the knife roll 116 to the first folding roll 180, several significant problems occur.

First, when this system is run in an interfolded mode, the adjacent sheets must be overlapped to allow for the interfolding process. To provide for the overlap, the knife roll 116 must be operated at a knife roll peripheral speed, illustrated by arrow 220 in FIG. 5, that is greater than a first folding roll peripheral speed, illustrated by arrow 222, of the first folding roll 180. The peripheral speed of a roll is the tangential speed of the corresponding roll and is not the angular speed. Rolls having different radial dimensions rotating at the same angular speed would have different peripheral speeds. The ratio between the knife roll peripheral speed 220 and the first folding roll peripheral speed 222 depends on the amount of overlap desired between adjacent sheets and will vary when operating in different modes.

For example, the machine 100 may be operated in a three panel or a four panel mode. In the three panel mode, the sheets 109 will be folded into three panels connected by two folds and only a single panel of adjacent sheets 109 may be overlapped. In such an arrangement, the ratio between the knife roll peripheral speed and the first folding roll peripheral speed will be 3/2. In the four panel mode, the sheets 109 will be folded into four panels connected by three folds and two panels of adjacent sheets 109 may be overlapped. In such an arrangement, the ratio between the knife roll peripheral speed and the first folding roll peripheral speed will be 4/2.

While the ratios are different depending on the relative amount of overlap, both ratios have the knife roll peripheral speed being greater than the first folding roll peripheral speed. This speed differential provides a significant issue in that the components of the knife roll 116 and the components of the first folding roll 180 must be configured such that they do not contact one another as they pass through the transfer nip 203, such as, when a leading end 214 is transferred between the knife and folding rolls 116, 180.

Another issues is that it is desirable to provide the smallest gap possible between adjacent rolls when transferring a sheet therebetween so as to eliminate issues in having the leading end 214 jump the gap as it transitions from one roll to the next.

Also, it is desired to have the leading end 214 located adjacent a tucker 190 of the first folding roll 180 when it is transferred thereto to facilitate downstream folding, and particularly interfolding, of the sheets 109.

While not necessary, it is desirable to also match the speeds of the leading end 214 with the roll to which it is being transferred to also promote a good transfer from one roll to another. As such, it is typically easier to transfer a leading end between two rolls that have the same peripheral speed.

Unfortunately, in the instant embodiment, the direct transfer from the knife roll 116 to the first folding roll 180 makes all of these things difficult to accomplish. More particularly, as noted above, the knife blade 168 extends radially outward from the outer periphery 122 of the knife roll body 118 and the tucker(s) 190 extend radially outward beyond the outer surface 200 of the first folding roll 180. To prevent the knife blades 168 and the tuckers 190 from contacting one another, the rolls 116, 180 are spaced apart further than typically desired to have a minimal gap to jump during transfer. More particularly, in one embodiment, the radius from the distal end 174 of the knife blade 168 to the knife roll axis of rotation 120 plus the radius from the distal end 198 of the tucker 190 to the first folding roll axis of rotation 184 is less than the distance between the knife roll axis of rotation 120 and the first folding roll axis of rotation 184.

The transfer of the leading end 214 of a sheet 109 to the first folding roll 180 is illustrated in FIGS. 7-14. The present embodiment utilizes the movable vacuum port 134 to help facilitate improved transfer between the knife roll 116 and the first folding roll 180.

Figure 7:
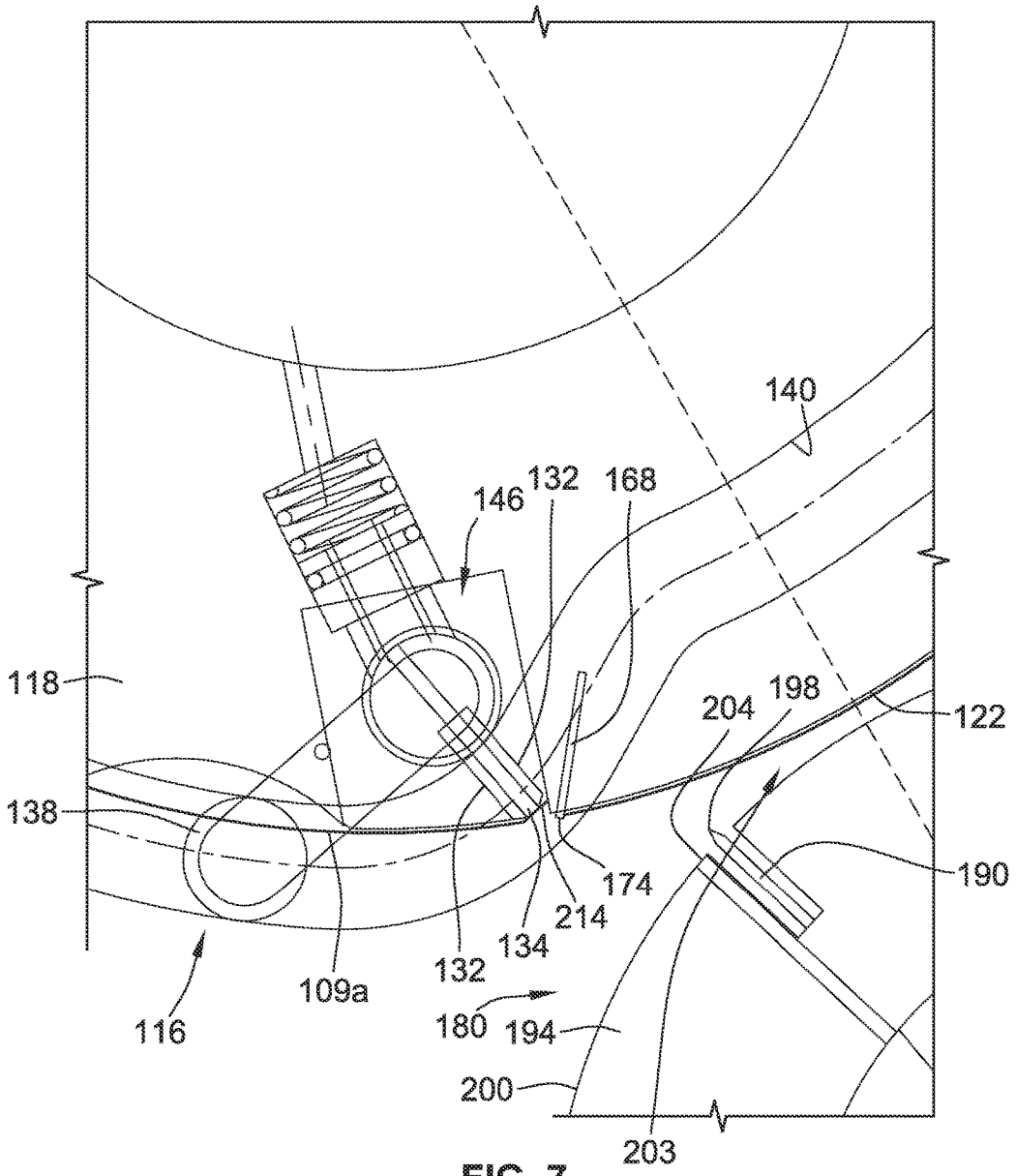
FIGS. 7-14 are enlarged simplified illustrations of a portion of the folding machine of FIG. 1 illustrating the process of transferring a leading end of a cut sheet from the knife roll to the first folding roll.

In FIG. 7, a leading end 214 of a sheet 109A is approaching the transfer nip 203 and is held to the knife roll 116 by movable vacuum port 134. Valve arrangement 146 is open allowing vacuum to be supplied to the movable vacuum port 134. The movable vacuum port 134 is positioned proximate the trailing side of the knife blade 168 and is in the same position as when the leading end 214 was formed by the cutting arrangement 108. In this position, there is little to no gap formed between the sheet 109A and the outer periphery of the knife roll 116. In this embodiment, the movable vacuum port 134 is positioned radially closer to the knife roll axis of rotation 120 than the distal end 174 of the knife blade 168.

In this position, the movable vacuum port 134, the leading end 214 and the distal end 174 of the knife blade 168 are further away from the transfer nip 203 than the tucker 190 of the first folding roll 180. As such, those components could be considered to be on a trailing side of the tucker 190.

Figure 8:
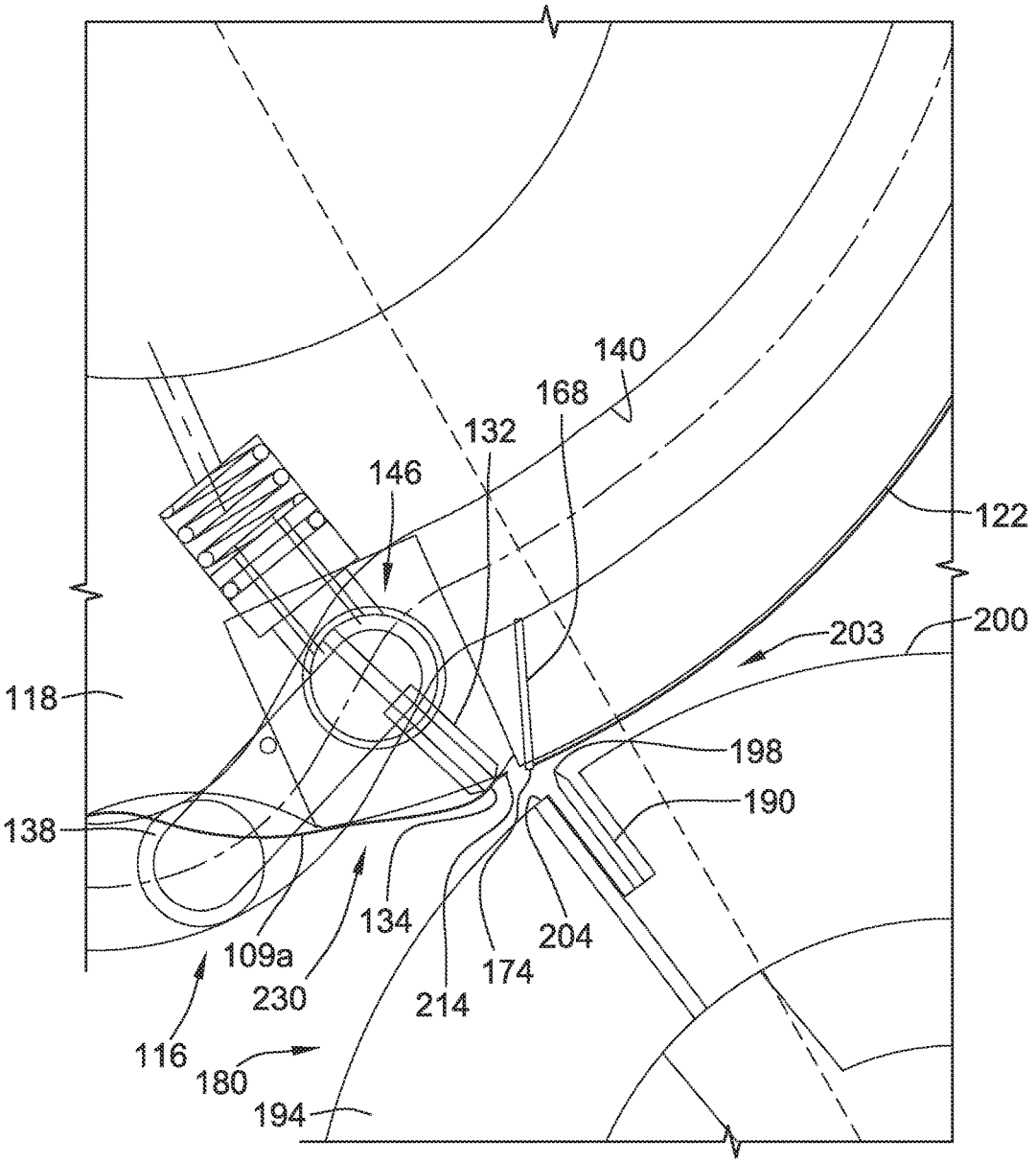

In FIG. 8, the leading end 214 is still held by movable vacuum port 134. The cam surface 140 starts to change shape to change the position of the movable vacuum port 134. More particularly, the movable vacuum port 134 starts to move away from the knife blade 168, i.e. in a direction relative to the knife roll body 118 that is opposite the direction the knife roll body 118 is moving. Because the movable vacuum port member 132 rotates, the movable vacuum port 134 thereof is also moving radially outward. Because the remainder of sheet 109A is fixed in place by vacuum ports 124, 126 (see FIG. 4), a bubble 230 in sheet 109A begins to form proximate leading end 214.

In this position, the movable vacuum port 134, distal end 174, and the leading end 214 are still further away from the transfer nip 203 than the tucker 190, but the difference has decreased.

Figure 9:
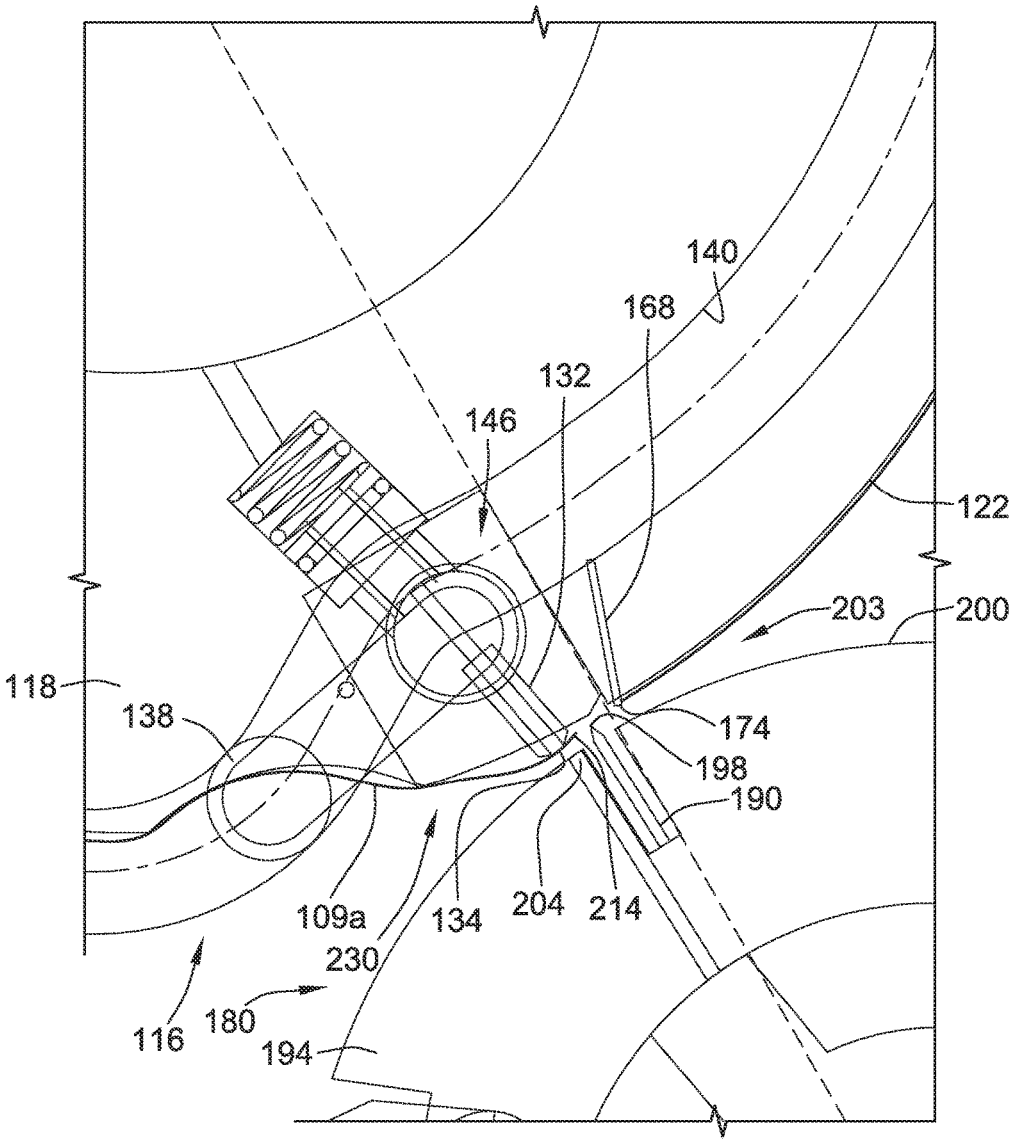

In FIG. 9, the leading end 214 is held by the movable vacuum port 134 and the valve arrangement 146 remains open. The movable vacuum port 134 is still moving away from distal end 174 of the knife blade 168 and bubble 230 continues to grow. The movable vacuum port 134 is still moving radially outward. At this point, the movable vacuum port 134 is radially further from the knife roll axis of rotation 120 than distal end 174 of the knife blade 168.

The distal end 174 of the knife blade 168 has passed the tucker 190 and is now considered to be on a leading side (also referred to as downstream side) of the tucker 190. The leading end 214 and the movable vacuum port 134 are still on the trailing side (e.g. upstream side) of the tucker 190 such that the tucker 190 is interposed between the knife blade 168 and the movable vacuum port 134.

Figure 10:
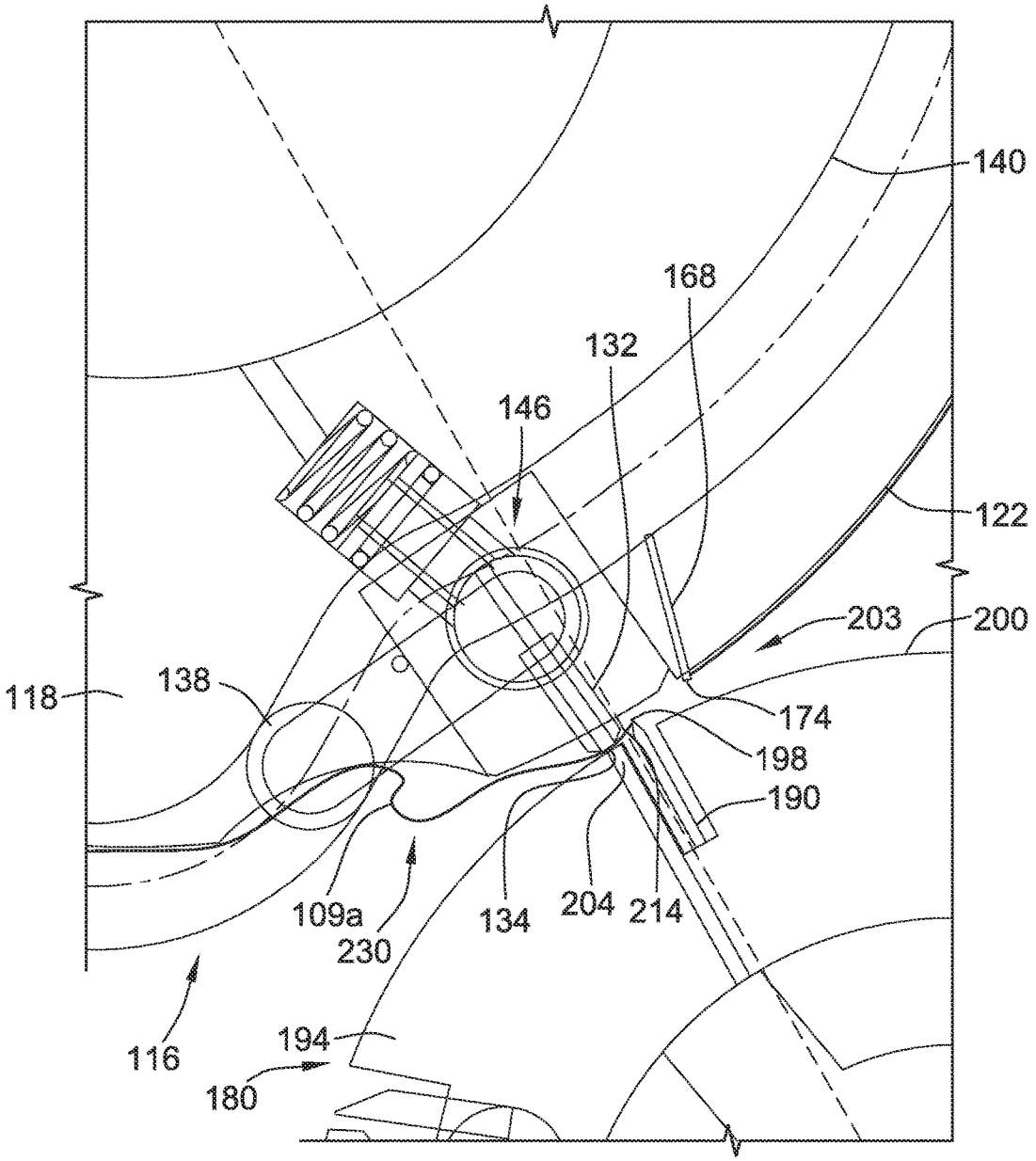
Figure 11:
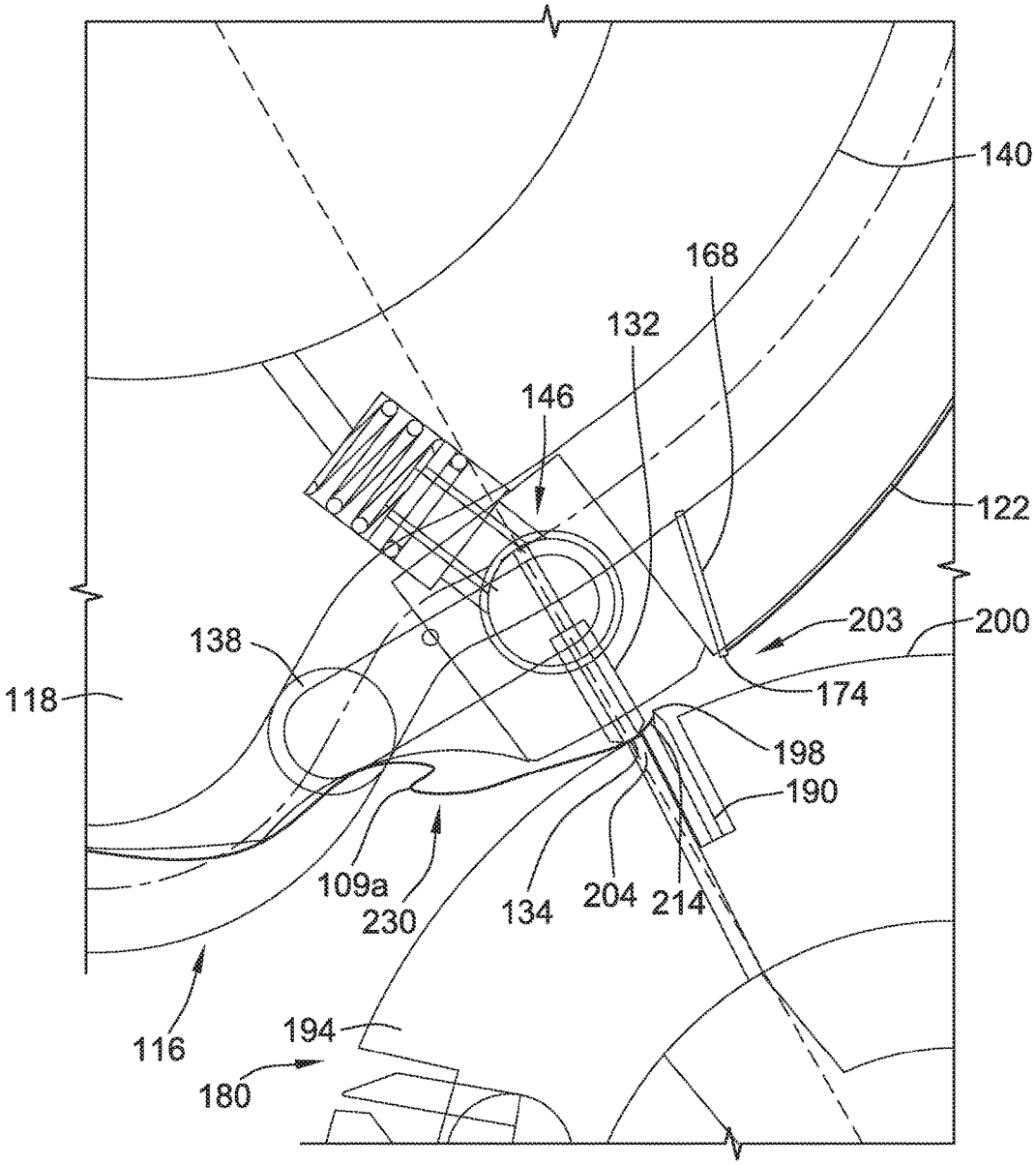

FIGS. 10 and 11 are similar to FIG. 9. The leading end 214 is still held by movable vacuum port 134 and valve arrangement 146 remains open. The movable vacuum port 134 has moved further away and is still moving away from the distal end 174 of the knife blade 168 and has moved and is still moving further radially outward. At this point, the leading end 214 and movable vacuum port 134 begin to align with first folding roll vacuum port 204.

Figure 12:
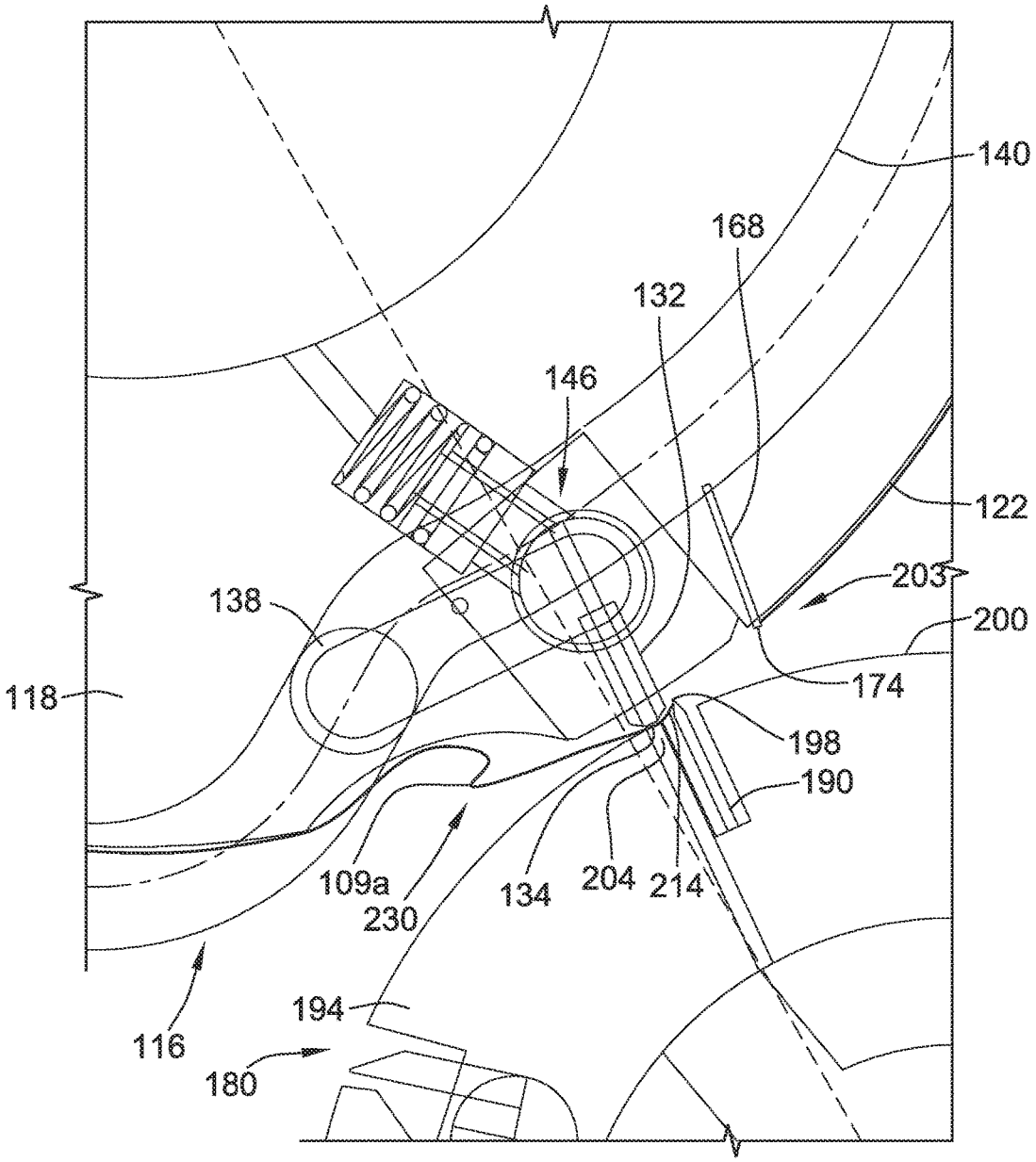

In FIG. 12, the movable vacuum port 134 has aligned with the first folding roll vacuum port 204 and the movable vacuum port 134 is at its maximum radial position from the knife roll axis of rotation 120. The movable vacuum port 134 and first folding roll vacuum port 204 are preferably substantially aligned with the transfer nip 203 in this position.

The roll that is holding the leading end 214 is being or is about to be changed from the knife roll 116 to the first folding roll 180. As such, the valve arrangement 146 has closed or is about to close to turn vacuum off at movable vacuum port 134. Vacuum has been turned on or is about to turn on at the first folding roll vacuum port 204.

Bubble 230 continues to grow because the movable vacuum port 134 is still moving away from the distal end 174 of the knife blade 168. Also, because the movable vacuum port 134 is moving away from the knife blade 168, i.e. in an opposite direction of travel as the knife roll body 118 relative to the knife roll body 118, the movable vacuum port peripheral speed of the movable vacuum port 134 is less than the knife roll peripheral speed 116. As such, the ratio of the movable vacuum port peripheral speed to the first folding roll peripheral speed is less than the ratio of the knife roll peripheral speed to the first folding roll peripheral speed. In other words, the motion of the movable vacuum port 134 relative to the knife roll body 118 reduces the speed difference of the leading end 214 relative to the first folding roll vacuum port 204 while the leading end 214 is being transferred to the first folding roll 180. This helps improve the quality of the transfer from the knife roll 116 to the first folding roll 180.

In a preferred embodiment, the profile of the cam surface 140 is configured such that there is zero differential speed between the folding roll 110 and the movable vacuum port 134 at the point of transfer. However, in some embodiments or in some modes, the a speed differential may still exist between the movable vacuum port 134 and the folding roll 110 at the point of transfer, but again, the speed differential is reduced due to the use of the movable vacuum port 134.

In some embodiments, the same cam profile may be used for different panel length sheets. For example, a same cam profile may be used for a three panel mode and for a four panel mode. However, because these different modes have different speed ration between the knife roll 116 and the first folding roll 180, if in one mode the speed differential is set to zero, the speed differential in the other mode must necessarily be non-zero. However, it has been contemplate that good results can occur even with some slight speed differential.

Figure 13:
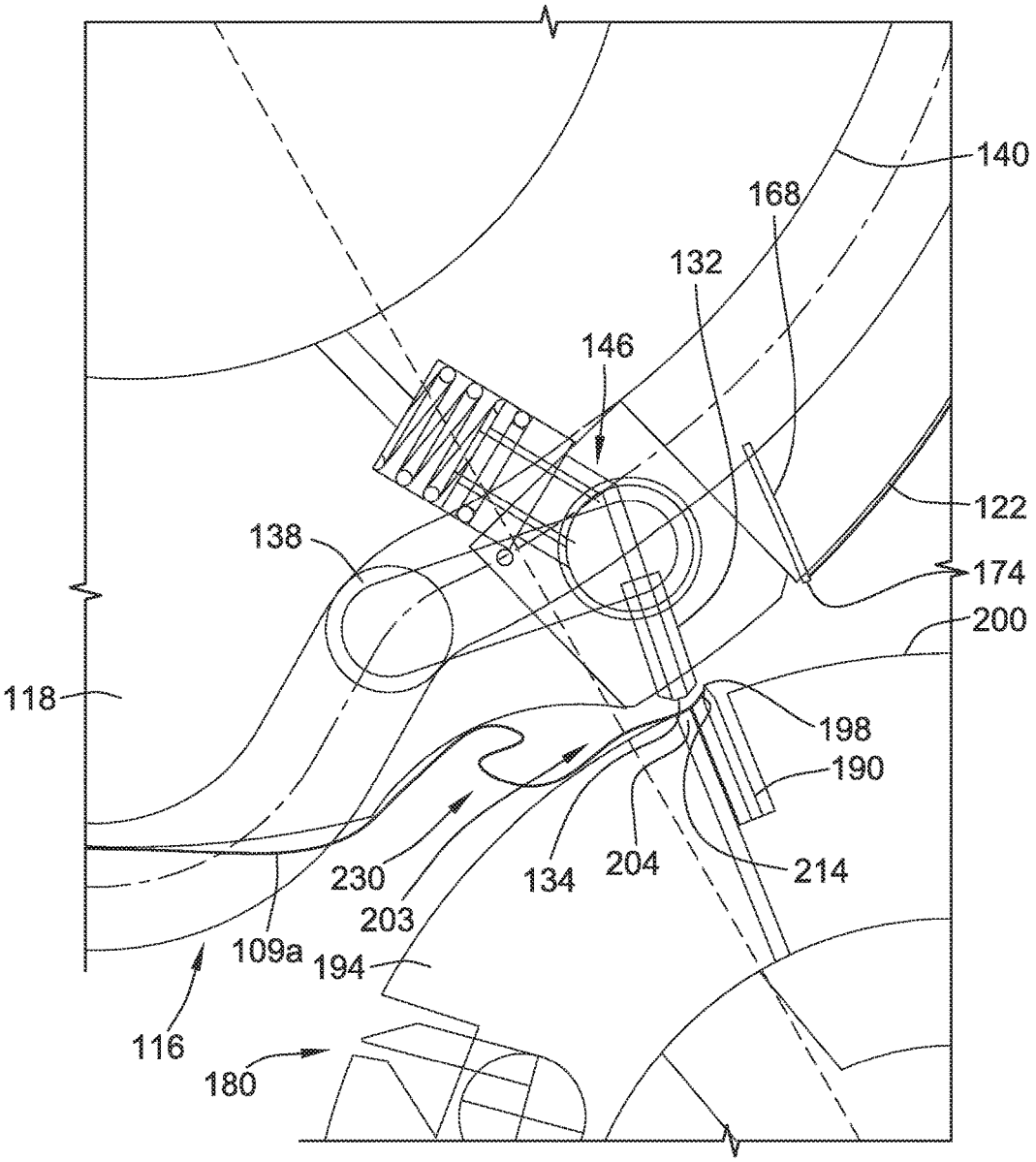

In FIG. 13, the valve arrangement 146 has been closed and vacuum has been turned off to movable vacuum port 134. Vacuum is on at first folding roll vacuum port 204 and the leading end 214 of sheet 109A has been transferred to the first folding roll 180.

An upstream portion of sheet 109A remains held to the knife roll 116 by the appropriate vacuum ports 124, 126.

The tucker 190 is still positioned between the knife blade 168 and the movable vacuum port 134. The movable vacuum port 134 is still moving away from the knife blade 168 relative to the knife roll body 118 and radially inward. At this point, the transition from the position in FIG. 11 to the Position in FIG. 13 provides an over-center motion where the movable vacuum port 134 transitions from moving radially outward (FIG. 11) to radially inward (FIG. 13).

Figure 14:
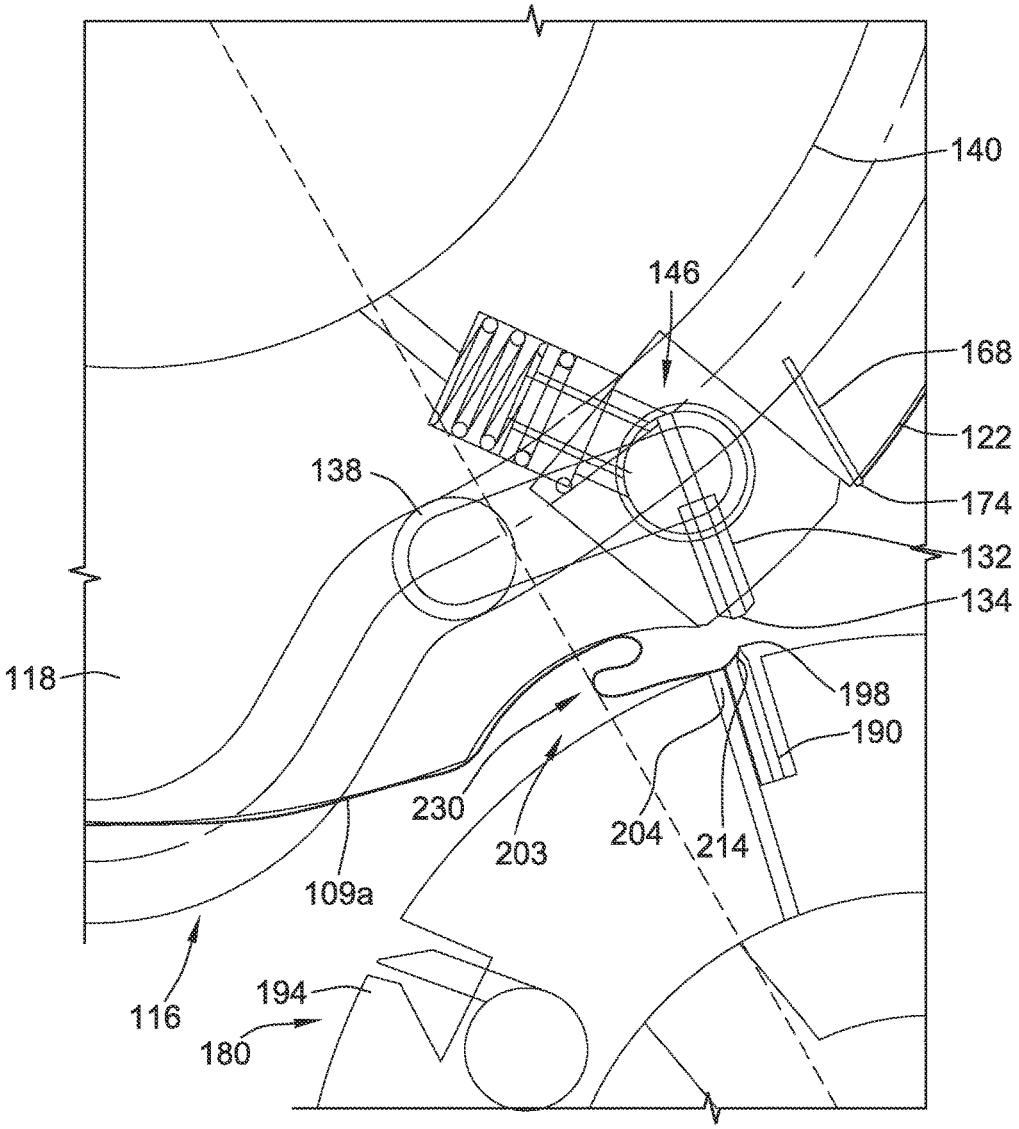

Now that the leading end 214 has been released from the movable vacuum port 134, the radial inward directed motion of the movable vacuum port is used to allow the distal end of the movable vacuum port member 132 that provides the movable vacuum port 134 to clear the distal end of the tucker 190 as the movable vacuum port 134 moves past the tucker 190 due to the difference in peripheral speeds at this point, as illustrated in FIG. 14.

After reaching the position illustrated in FIG. 14, the cam surface 140 is configured to reset the position of the movable vacuum port 134 back towards the knife blade 168 so as to be positioned to hold another sheet 109. Typically, this resetting motion will require the movable vacuum port 134 to move radially outward until it passes the over-center position and then radially back inward as it approaches the knife blade 168 (i.e. the opposite motion as described with reference to progression illustrated in FIGS. 7-14).

Returning to FIG. 1, the knife roll 116 has progressed from the position in FIG. 14. FIG. 1 illustrates that a significant bubble 230 has formed in sheet 109A. Sheet 109A has been released by fixed position vacuum port 124 and two of the fixed position vacuum ports 126. The bubble 230 provides a space for the leading end of the next sheet 109B held by the knife roll 116 to be located under sheet 109A to allow for the overlap necessary to provide for interfolding adjacent sheets 109A and 109B.

FIG. 1 also illustrates that sheet 109A is positioned in overlapped relation with downstream sheet 109C. Sheet 109A is positioned between at least part of sheet 109C and the first folding roll 180.

The process described above will then repeat with the next sheet in line, namely sheet 109B in FIG. 1.

The previously described process highlights how the movable vacuum port member 132 and its movable vacuum port 134 allow for the spacing between the knife roll 118 and the first folding roll 180 to be such that radially outward projecting components thereof, namely the knife blades 168 of the knife roll 116 and the tuckers 190 of the first folding roll 180 can clear each other proximate transfer nip 203 while preventing the leading end 214 of a sheet 109 from having to jump a large gap.

In FIG. 5, the distal end 174 of the knife blade 168 defines a cylindrical knife blade operating zone, which a theoretical cylinder is having a radius from the knife roll axis of rotation equal to the radius to the distal end 174 of the knife blade 168. This the maximum area in which the knife blade 174 will travel as the knife roll 116 rotates. This is particularly the case if the knife blades 168 remain in a fixed position during normal operation.

Similarly, the distal end of the movable vacuum port member 132, when in its radially outward most position, such as illustrated in FIG. 5 and FIG. 12, defines a movable vacuum port operating zone which is a theoretical cylinder about the knife roll axis of rotation 120. Again, this cylinder represents the area in which the movable vacuum port member 132 could be positioned while rotating about the knife roll axis of rotation 120. In this embodiment, this is the maximum operating zone of the knife roll 116 as the distal end of the movable vacuum port member 132 can extend the furthest radially outward from the knife roll axis of rotation 120.

The distal end 198 of the tucker 190 defines a tucker operating zone, which is a theoretical cylinder having a radius from the first folding roll axis of rotation 184 to distal end 198.

In some configurations, the knife blade operating zone and the tucker operating zones would not overlap. This would be particularly true if the knife blades 168 are in a constant position relative to the knife roll body 118 as the knife roll 116 rotates and the tuckers 190 are in a constant position relative to the first folding roll body 194 as the first folding roll 180 rotates. However, with reference to, at least, FIGS. 10-13, the movable vacuum port member operating zone would overlap with the tucker operating zone. The movable vacuum port members 132 allow for this overlap but prevent any or any significant interference between the movable vacuum port members 132 and the tuckers 190 during sheet transfer. Instead, the movable vacuum port member 132 is allowed to navigate within the overlapped region, e.g. within the tucker operating zone, without contacting or significantly contacting the tucker 190. Ultimately, the goal is to prevent contact based on timing. However, at a minimum, the goal is to prevent catastrophic damage due to incidental contact.

It should be noted that the cam followers 138 are axially spaced or offset from the knife roll body 118 and the first folding roll body 194 such that the cam followers 138 will not interfere with the first folding roll 180.

With reference to FIGS. 2-4, the knife roll 116 of that embodiment is a highly adaptive knife roll 116 that can be configured for automatic transitioning between different modes for forming sheets of different lengths and different number of panels. More particularly, the use of linear actuators 142 and cylinders 172 allows for control of which knife blades 168 and movable vacuum ports 134 are active. In a first mode, a first set of knife blades 168 and a corresponding set of movable vacuum ports 134 can be active.

For instance, when operating in a first mode, a first set of knife blades includes three of the knife blades 168 that are active. In the first mode, a first set of movable vacuum ports includes three movable vacuum ports 134 that are also active. These three active knife blades 168 and vacuum ports 134 would be angularly evenly spaced about the knife roll axis of rotation 120 by 120 degrees. The circumference of the periphery of the knife roll 116 is equivalent to twelve

(12) panel lengths. As such, in the first mode, the knife roll 116 is configured to form sheets being four (4) panel lengths long.

The knife roll 116 could then be automatically switched to operate in a second mode where a second set of knife blades 168 including, for example, four knife blades 168 and a second set of movable vacuum ports 134 including, for example, four movable vacuum ports 134 would be active. The active knife blades 168 and movable vacuum ports 134 would be evenly angularly spaced apart about the knife roll axis of rotation 120 by 90 degrees. In this mode, shorter sheets would be formed as there is a shorter distance between the knife blades 168 along the periphery of the knife roll 116. Because the circumference of the periphery of the knife roll 116 is equivalent to twelve (12) panel lengths, in the second mode, the knife roll 116 is configured to form sheets being three (3) panel lengths long.

It should be noted that the instant embodiment is configured such that one of the knife blades 168 forms part of the first and second sets of knife blades. Additionally, one of the movable vacuum ports 134 forms part of the first and second sets of movable vacuum ports.

To drive the knife roll 116 and first and second folding rolls 180, 182, a drive mechanism is provided that includes one or more sources of power, typically electric motors. In the illustrated embodiment, to make the system fully automatically transitionable between the first and second modes, it is desired to use a knife roll drive mechanism that is wholly independent from a folding roll drive mechanism. As such, the rotational speeds of the knife roll 116 can be independently adjusted from the rotational speeds of one or both of the first and second folding rolls 180, 182.

Preferably, the knife roll drive mechanism 234 is a servo motor that is connected to a control arrangement 236. The control arrangement 236 is configured to adjust the ratio between the knife roll 116 and the folding rolls 180, 182.

Preferably, the folding roll drive mechanism includes a pair of servo motors 238, 240 that are operably coupled to the control arrangement 236 such that the servo motors 238, 240 can be independently controlled for independently controlling the rotational speeds of the first and second folding rolls 180, 182. However, because the first and second folding rolls 180, 182 will typically be driven at a same speed so that cooperating tuckers 190 and grippers 192 will always align, the driving thereof could be coupled and powered by a single motor.

Further, while the control arrangement 236 is illustrated as a single component, it could be separated into separate controllers for each drive mechanism. Further, the individual controllers could then communicate with a master controller.

Further yet, in other embodiments, the drive mechanism that drives the knife roll 116 and the folding rolls 180, 182 could be coupled. In some such embodiments, a multi-speed gearbox could be incorporated and used to change the speed ratios of the different components.

Other operational modes are contemplated by the folding machine 100 of FIG. 1. While it is contemplated that the machine 100 would be operated such that the knife blades 168 would remain in a fixed position at all times when the machine 100 is operating, other operational modes contemplate transitioning the knife blades 168, via knife blade holder 170 and cylinder 172 between active and inactive positions as the knife roll 116 rotates. For instance, the machine could be configured to form a zig-zag folded sheet that has a very large number of panels, e.g. in excess of 20 panels and more preferably in excess of 40 panels and even more preferably in excess of 60 panels.

In such a case, where the knife roll 116 has an outer periphery of a circumference of approximately twelve (12) panel lengths, a cut would only have to be executed once every five rotations of the knife roll 116. In such a case, in one mode, all of the knife blades 168 would be retracted to an inactive position and only once every five (5) rotations a corresponding knife blade 168 would be actuated to an active position by cylinder 172. This could be performed by use of a control arrangement, such as control arrangement 236 in FIG. 1.

It should be noted that in a zig-zag mode, the peripheral speed ratio between the knife roll 116 and the folding rolls 180, 182 is one (1) as the rolls rotate at the same speeds because no overlap for interfolding is required.

While the system is configured to automatically switch between different sets of knife blades and movable vacuum ports 134, some systems may require manually switching between the modes such as by having a user actually remove some knife blades and add other knife blades in different positions to switch between modes.

Further yet, the direct transfer concept of directly supplying sheets from a knife roll to a folding roll can be incorporated into machines that are not flexible and can only operate in a single mode.

Figure 15:
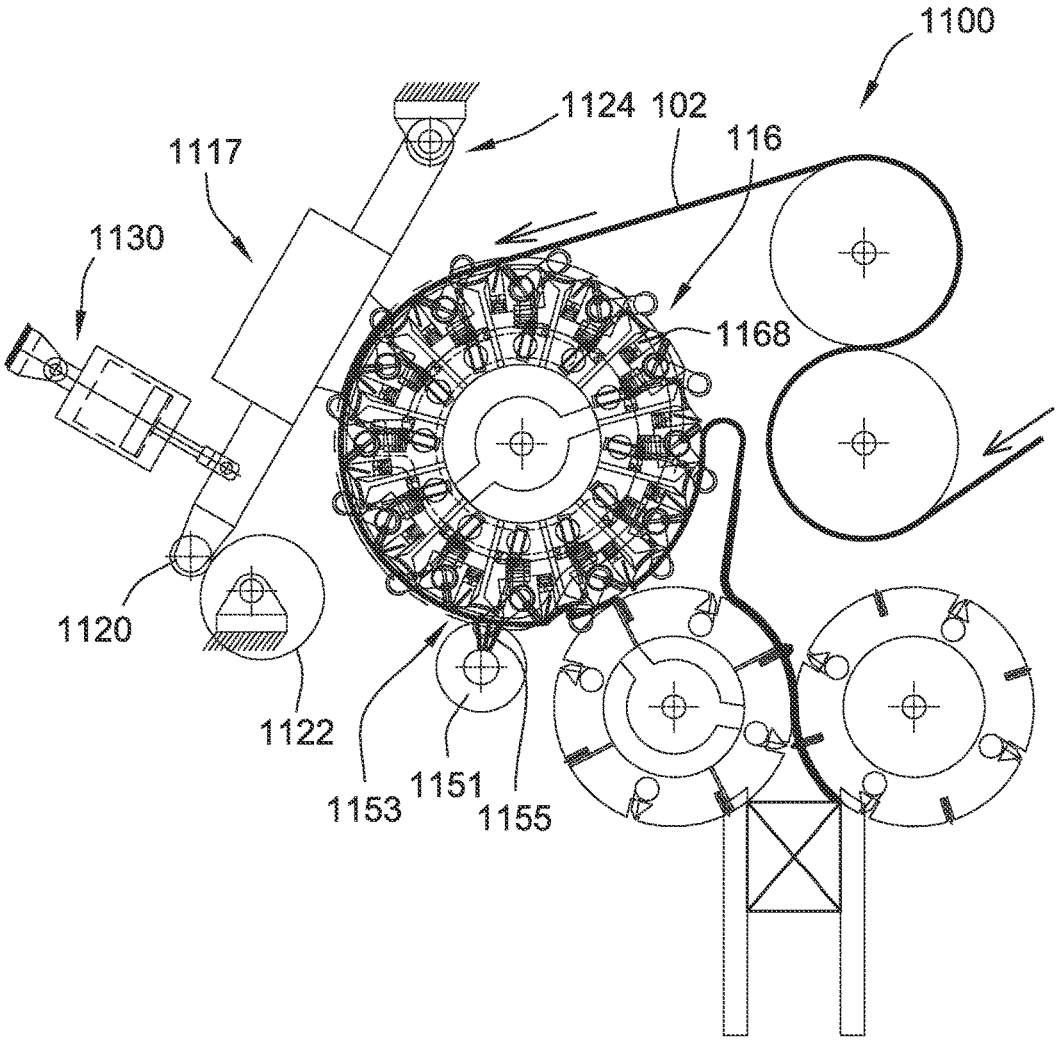
FIG. 15 is a further embodiment of a system that is highly flexible and includes more knife arrangements for allowing for further configurability as well as illustrating a cam actuated anvil.

Other embodiments, such as system 1100 illustrated in FIG. 15, utilize a cam actuated anvil 1117 that selectively transitions the anvil 1117 between active and inactive positions. The cam actuated anvil 1117 includes a cam follower 1120 that cooperates with an eccentric rotating cam 1122 to pivot the anvil 1117 toward and away from knife roll 116. This type of mechanism may be beneficial when the folding machine is contemplated to form long sheets, such as for zig-zag configurations.

The anvil 1117 is pivotally mounted proximate an end 1124 opposite the end that includes cam follower 1120. A biasing mechanism 1130 is coupled to the anvil 1117. The biasing mechanism may be an actuator, a spring, a damper or other mechanism.

When using this type of anvil 1117, it is contemplated that if the web of material 102 is strong enough, the appropriate knife blades 1168 could stay active with the web extending thereacross even at locations where a cut is not to be performed. Alternatively, the knife blades 1168 could be operatively actuated as discussed previously.

The embodiment of FIG. 15 also includes a tail roll 1151. The tail roll 1151 and knife roll 1116 form a tail-knife nip 1153 therebetween. The tail roll 1151 includes a plurality of vacuum ports 1155 configured to life the trailing end portion of a sheet off of the knife roll 116 such that a leading end of an upstream sheet can be moved between that lifted trailing end portion and the knife roll to effectuate an overlap between adjacent sheets. This type of overlap assists in the requisite overlap for a single-fold type product. This operation is disclosed in U.S. Pat. Publ. No. 2013/0296153 to Walsh et al. having U.S. application Ser. No. 13/460,960, and filed on May 1, 2012, the teachings and disclosures thereof being incorporated herein by reference thereto.

When forming such a single-fold interfolded product using a single path folding machine, the knife roll 116 of FIG. 15 would operate like the lap roll of U.S. Pat. Publ. No. 2013/0296153.

FIGS. 16-25 illustrate different sheet products that are contemplated that could be formed using the folding machines as described herein depending on the operational modes thereof. The even numbered figures illustrate a sheet overlap configuration without folds. The horizontal lines illustrate fold locations where a fold would be formed. The odd numbered figures illustrate the product, in an exaggerated form, after being folded. These are not the only sheet products that are contemplated to be formed.

Figures 16, 17, 18, 19, 20, 21, 22, 23, 24, 25:
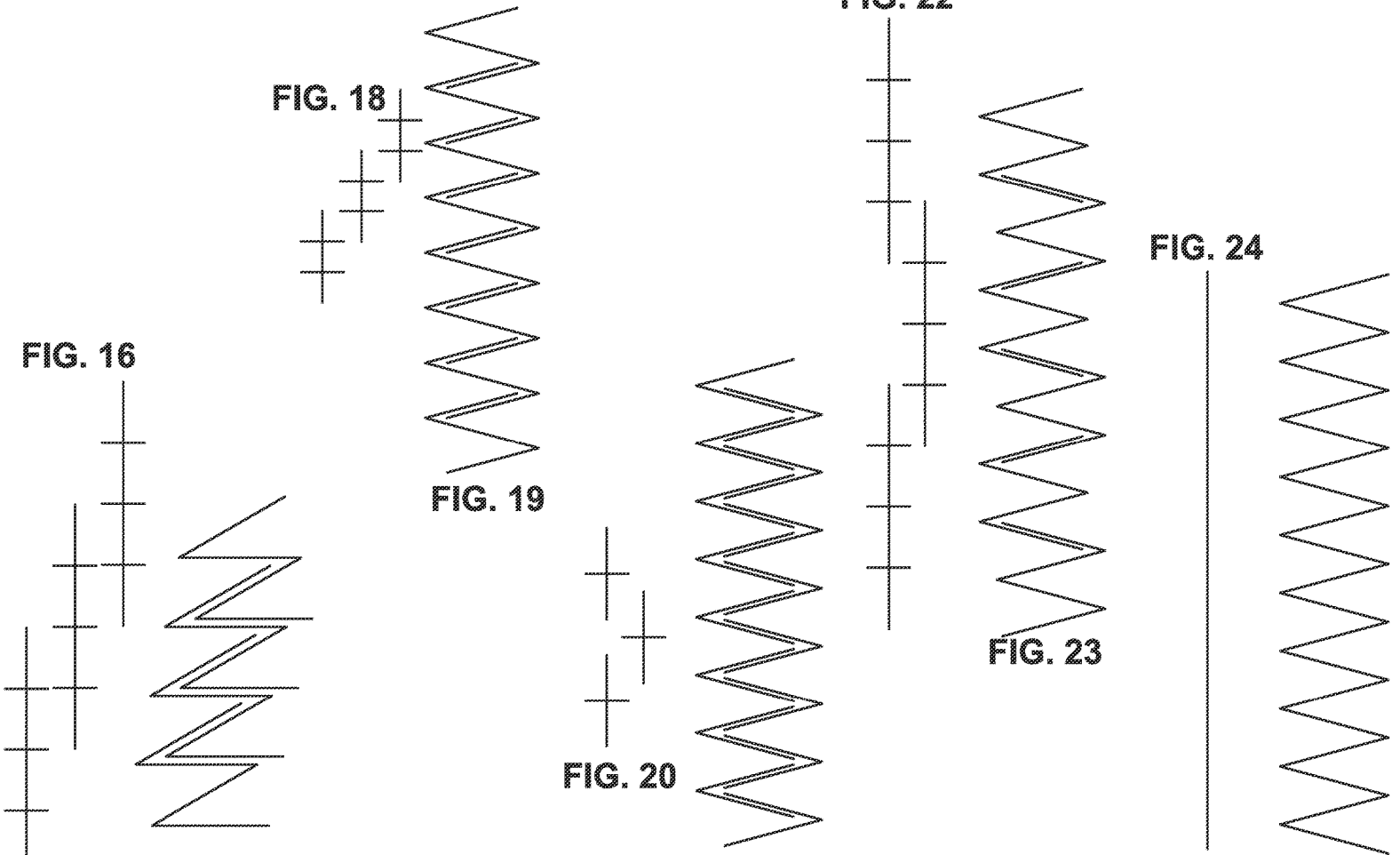
FIGS. 16-25 illustrate different overlap and corresponding folded products that can be formed using the folding machines of FIGS. 1 and 15.

FIGS. 16 and 17 illustrate what is referred to as a four panel multifold product. Here, each sheet has four panels connected by three folds and two panels of adjacent sheets overlap one another.

FIGS. 18 and 19 illustrate what is referred to as a three panel multifold product. Here, each sheet has three panels connected by two folds. One panel of adjacent sheets is overlapped.

FIGS. 20 and 21 illustrate a two panel single fold product. Here, each sheet has two panels connected by a single fold. One panel of adjacent sheets is overlapped.

FIGS. 22 and 23 illustrate a four panel single overlap product. Here, each sheet has four panels connected by three folds. One panel of adjacent sheets is overlapped.

FIGS. 24 and 25 illustrate a zig-zag folded product that has a large number of panels such as in excess of 20 panels connected by the appropriate number of folds, e.g. one less fold than the number of panels.

While the use of drive mechanisms for the knife roll 116 and the first and second folding rolls 180, 182 are beneficial for automatically switching between different operational modes, in the event of a power loss or mechanical failure, the motion of the knife roll 116 and the folding rolls 180, 182 is not mechanically coupled, such as by way of chains or gearing. As such, the individual rolls 116, 180, 182 can enter a free-wheel or locked state such that the individual rolls get out of sync with one another.

The present embodiment with the movable vacuum port members 132 allows for, at least, the knife roll 116 and first folding roll 180 to be significantly spaced apart such that if an out of sync state is experienced, the components of the knife roll 116, and particularly the knife blades 168 and movable vacuum port members 132, will not contact or run into the components of first folding roll 180, and particularly the tuckers 190.

Further, the movable vacuum port members 132, via linear actuators 142 (FIGS. 2-4) can be configured to have a fail safe mode where if such a power loss or mechanical failure is experienced that the movable vacuum port members 132 are automatically transition to a radially inward position such that they will not contact the tuckers 190 either. This would typically be done by lifting the cam followers 138 from the cam surface 140.

While the movable vacuum ports 134 and movable vacuum port members 132 of the knife roll 116 are illustrated as part of the knife roll 116, in other embodiments the movable vacuum port members 132 could be part of, in addition to or alternatively, the first and/or second folding rolls 180, 182.

Further, while the movable vacuum ports 134 and movable vacuum port members 132 find particular benefit in a system that incorporates direct sheet transfer from a knife roll 116 to a folding roll 180, the concepts embodied therein could be incorporated into other web handling rolls such as lap rolls, transfer rolls, etc. Further, the concepts could be used in other transfer configurations such as from a knife roll 116 to a lap or transfer roll or from a lap or transfer roll to a folding roll. This is particularly true as the movable vacuum port concept allows for reducing the speed differential between adjacent rolls when transferring the leading end of a sheet to a roll.

Figure 26:
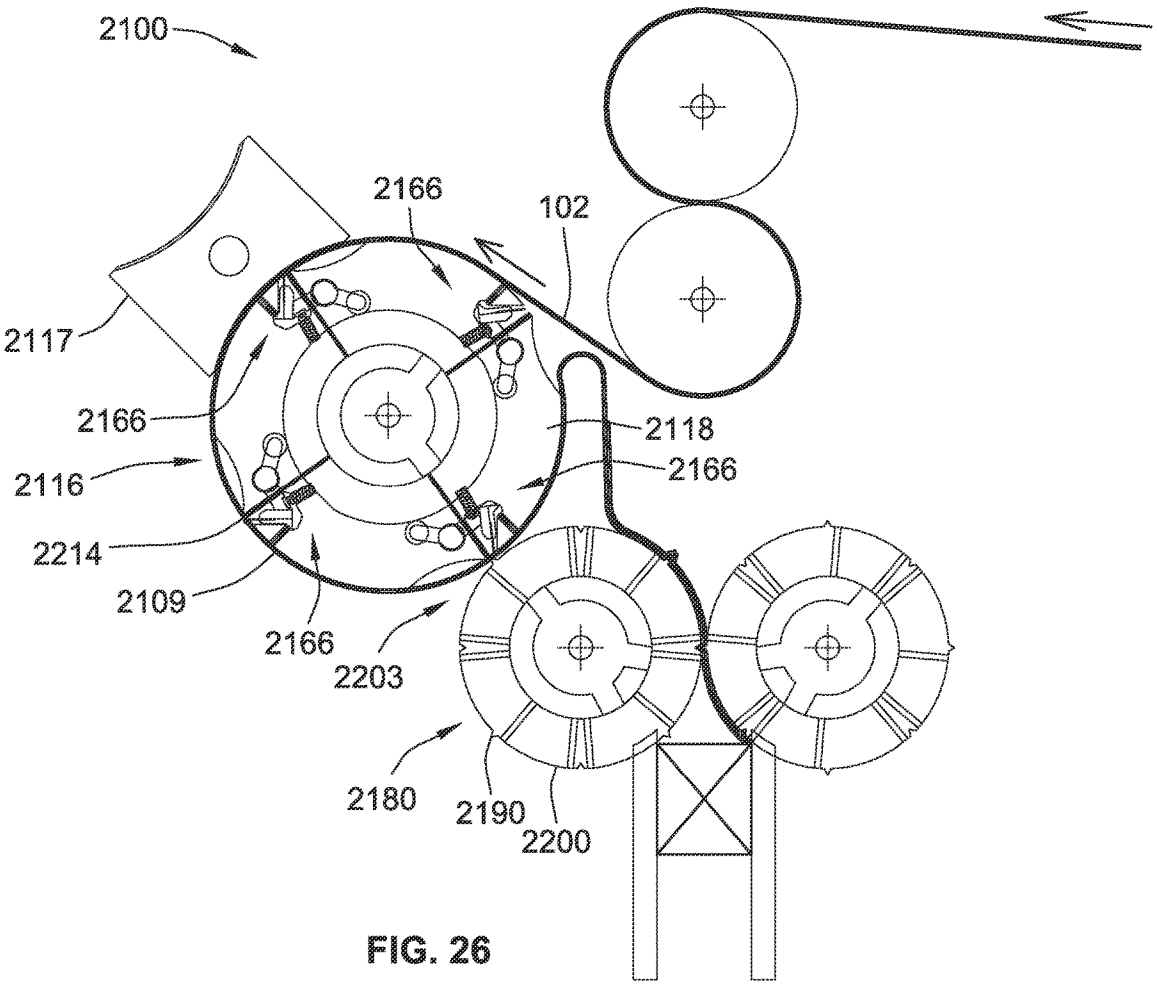
FIG. 26 illustrates a further folding machine that includes cam actuated knife blades.

FIG. 26 illustrates a further embodiment of a folding machine 2100 configured to allow for direct transfer of a cut sheet 2109 from a knife roll 2116 to a first folding roll 2180. Again, the machine 2100 may be operated to form interfolded sheets from a single web of material 102.

The knife roll 2116 includes a plurality of actuatable knife blade arrangements 2166 that can be selectively actuated between active and inactive positions (also referred to as active and inactive states) to selectively cooperate with anvil 2117 to sever the web 102 into sheets 2109.

Figure 27:
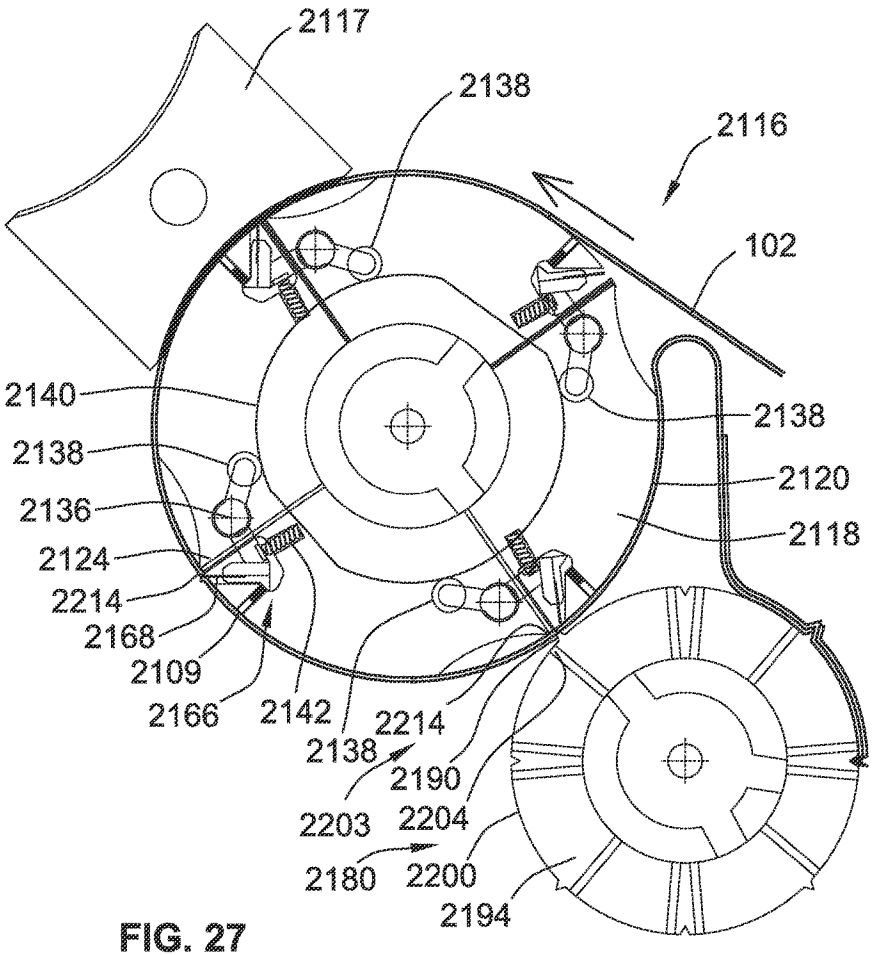
FIG. 27 is an enlarged partial illustration of the folding machine of FIG. 26.

With additional reference to FIG. 27, in the illustrated embodiment, the actuatable knife blade arrangements 2166 include a cam follower 2138 that cooperates with a cam surface 2140 to selectively actuate between the active and inactive positions.

The cooperation of the cam follower 2138 and cam surface 2140 in conjunction with a biasing mechanism illustrated in the form of springs 2142 cause the knife blade arrangements 2166 to pivot about knife blade axis of rotation 2136 to transition the knife blades 2168 between active and inactive positions. It is noted that the springs 2142 provide a torque about the rotational axis 2136 that biases the knife blade 2168 radially outward toward the active position. The cam surface will thus act to provide an oppositely directed torque to cause the knife blade to transition to the inactive position.

Typically, the knife blades 2168 will be actuated radially outward and beyond the outer periphery 2120 of a knife roll body 2118 during cutting operations. After the cutting operations, the cam surface 2140 causes the knife blade arrangements 2166 to pivot to cause the knife blades 2168 to transition radially inward to an inactive position. The knife blades 2168 will transition radially inward to at least flush with outer periphery 2120. At a minimum, they will be transitioned radially inward while the knife blades 2168 approach and pass through transfer nip 2203 so as to avoid interference with radially outward projecting tucker 2190 of the first folding roll 2180.

Because the tucker 2190 projects outward beyond outer surface 2200 of the first folding roll body 2194, in this configuration, the leading end 2214 of a sheet 2109 must jump a larger gap between the knife roll 2116 and first folding roll 2180. However, the gap is less than if the knife roll 2116 and first folding roll 2180 would have to be spaced apart to additionally accommodate the knife blade 2168 projecting outward beyond outer periphery 2120.

In this embodiment, the vacuum ports 2124, 2204 of the knife roll 2116 and first folding roll 2180 are illustrated as simplified fixed position vacuum ports. However, the system could incorporate movable vacuum ports as previously discussed to further reduce the gap required to transfer the leading end 2214 of a sheet from the knife roll 2116 to the first folding roll 2180.

While FIGS. 26 and 27 illustrate cam actuated knife blades 2168, other embodiments could use linear actuators to selectively actuate the knife blades. The embodiment of the knife roll illustrated in FIG. 1 includes a contemplated configuration of such a linear actuator. The linear actuator could be fluidly or electrically operated.

Figure 28:
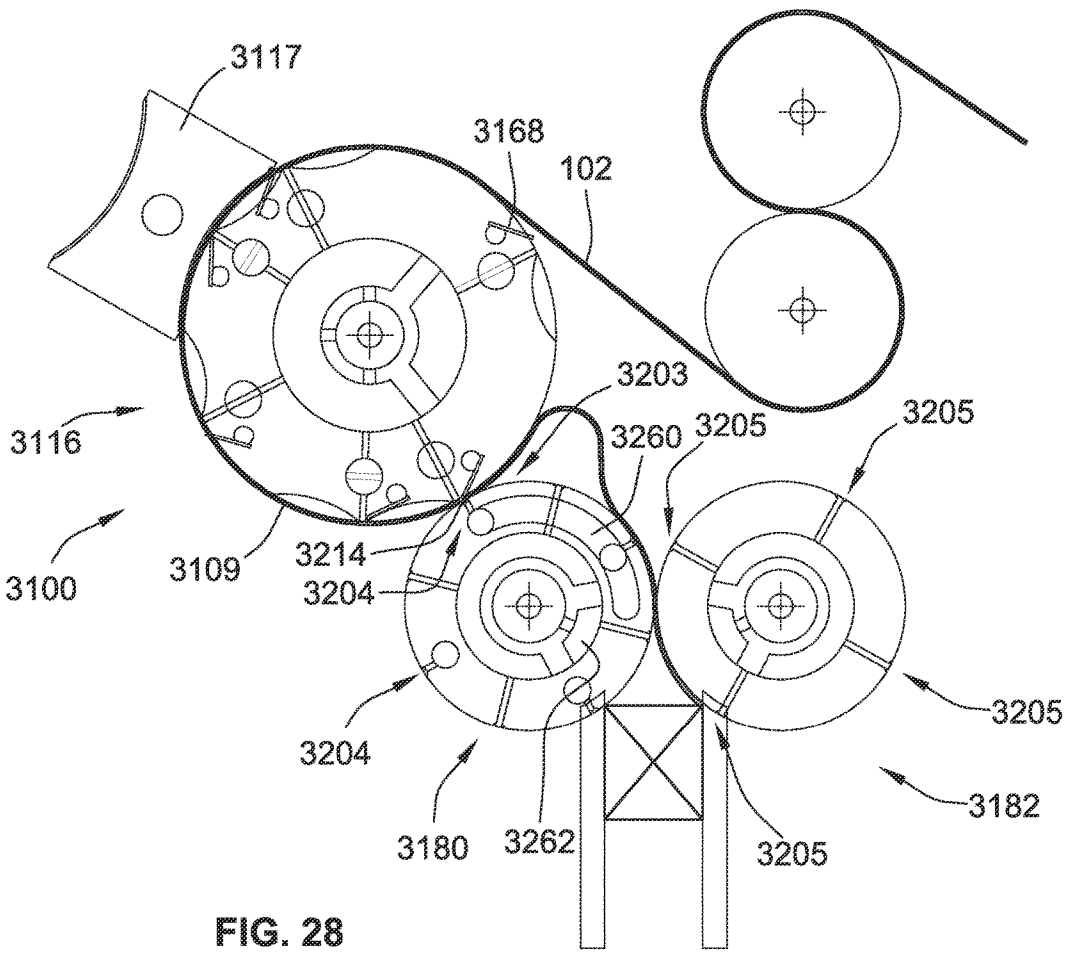
FIG. 28 is an embodiment of a further folding machine that uses direct sheet transfer from a knife roll to a folding roll and that uses vacuum folding techniques.

FIG. 28 illustrates a further folding machine 3100. The folding machine 3100 utilizes a direct transfer of a cut sheet 3109 from the knife roll 3116 to the first folding roll 3180.

The knife roll 3116 includes a plurality of knife blades 3168 that cooperate with anvil 3117 to sever a continuous web 102 of material into a stream of sheets 3109 like the previously discussed systems. The knife blades 3168 may be fixed position knife blades or be actuated knife blades. Further, the system may be operated in numerous different modes to form sheets and overlapped product having different configurations (e.g. different amount of overlap, different sheet length, or combinations of both).

In this system, the first and second folding rolls 3180, 3182 utilizes vacuum ports to form the folds within the sheets rather than mechanical tuckers and grippers as discussed previously. More particularly, the first and second folding rolls 3180, 3182 include folding ports 3205 (also referred to as "gripper ports"). The sheets 3109 are vacuum sucked into the folding ports 3205 to form the folds in the sheets rather than using a mechanical tucker to guide a sheet into a mechanical gripper which forms a fold in a sheet.

The first folding roll 3180 also includes vacuum ports 3204 for holding, at a minimum, the leading end 3214 of a sheet 3109 to the first folding roll 3180. It is at these vacuum ports 3204 that assist in the direct transfer of the leading end 3214 of a sheet from the knife roll 3116 to the first folding roll 3180.

Because the first folding roll 3180 does not include the radially outward extending tuckers, there is less risk of interference between the components of the knife roll 3116 and the components of the folding roll 3180. This also allows the gap between the knife roll 3116 and the first folding roll 3180 at the transfer nip 3203 to be reduced such that it is not as difficult for the leading end 3214 to jump from the knife roll 3116 to the first folding roll 3180.

In this embodiment, vacuum ports 3204 fluidly communicate with a first vacuum system 3260 for selectively supplying vacuum to the vacuum ports 3204 that hold, at least, the leading end 3214 of the sheets 3109.

The folding ports 3205 cooperate with a second vacuum system 3262 that selectively supply vacuum to form the folds in the sheets 3109.

While this system is illustrated with only fixed position vacuum ports for both the knife roll 3116 and the first folding roll 3180, some of the vacuum ports, such as the vacuum ports that transfer the leading end 3214 of a sheet between the knife roll 3116 and the first folding roll 3180 could incorporate the movable vacuum ports discussed previously. The use of the movable vacuum ports in this system would allow for reducing or eliminating the peripheral speed differential between the knife roll 3116 and folding roll 3180 while transferring the leading end 3214 of a sheet 3109. Again, the peripheral speed differential exists to allow for the overlapping of adjacent sheets 3109.

Figure 29:
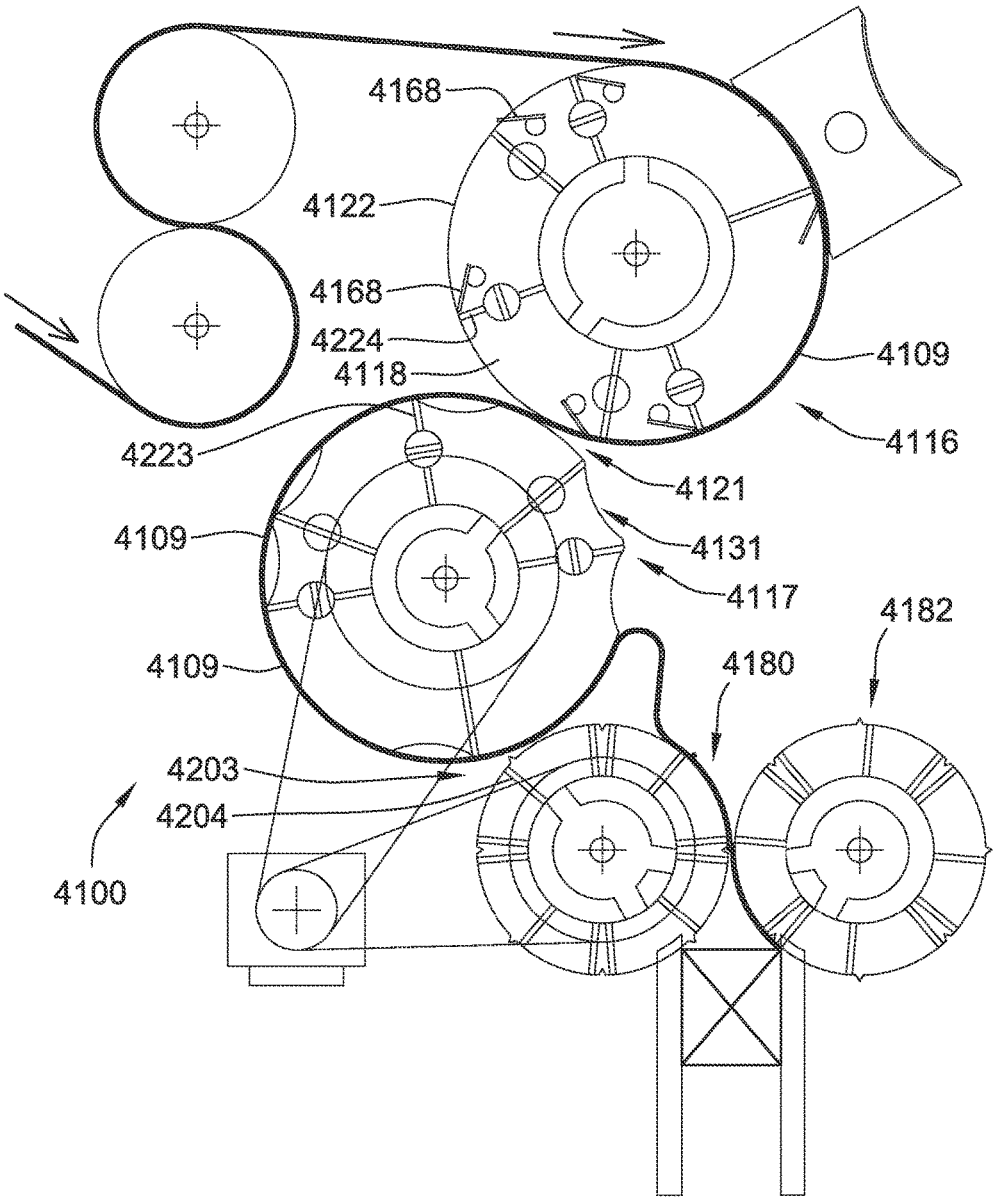
FIG. 29 is a further embodiment of a folding machine that utilizes a lap roll between the knife roll and the folding arrangement.

FIG. 29 illustrates a further embodiment of a folding machine 4100. This embodiment utilizes a knife roll 4116 that is reconfigurable between different operating modes for forming sheets having different sheet lengths and thus different number of folded panels. The folding machine 4100 is configured to be an interfolding machine were panels of adjacent sheets are interfolded with one another as discussed above.

The folding machine 4100 includes a knife roll 4116, a lap roll 4117 and a pair of folding rolls 4180, 4182.

The knife roll 4116 is reconfigurable between different arrangements for cutting sheets 4109 having different lengths such as for example operating in a three-panel mode, a four-panel mode or even a zig-zag mode. Clearly other modes are contemplated as well.

The knife roll 4116 includes a plurality of knife blades 4168 that are selectively extendable or retractable between active and inactive positions as discussed above. As such, the knife roll 4116 can be seen to have different sets of knife blades 4168 for forming different sized sheets.

In this embodiment, the cut sheets 4109 are transferred from the knife roll 4116 to the lap roll 4117 at a lap-knife roll nip 4121. In this embodiment, the knife roll 4116 and the lap roll 4117 have a same peripheral speed.

The lap roll 4117 includes a plurality of recesses 4131 configured to accommodate the active knife blades 4168 during transfer to avoid damage thereto and to allow for a reduced gap between the knife roll 4116 and the lap roll 4117 at the lap-knife nip 4121. In one embodiment, the peripheral speed of the knife roll 4116 is equal to the peripheral speed of the lap roll 4117.

The lap roll 4117 has a plurality of vacuum ports 4223 that correspond to vacuum ports 4224 of the knife roll 4117. Depending on which knife blades 4168 of the knife roll 4116 are active, will determine which vacuum ports 4223 are active in the lap roll 4117. Thus, the lap roll 4117 can be seen to have different sets of vacuum ports 4123 that can be activated depending on the operating mode of the system.

Downstream from the lap roll 4117 is the first folding roll 4180. The lap roll 4117 and the first folding roll 4180 form a lap-folding nip 4203 therebetween where the sheets 4109 are transferred from the lap roll 4117 to the first folding roll 4180. In one embodiment, the peripheral speed of the lap roll 4117 is greater than the peripheral speed of the first folding roll 4180 such that adjacent sheets can be overlapped to facilitate interfolding adjacent sheets.

The first folding roll 4180 has vacuum ports 4204 that assist in transferring the leading end of sheets 4109 from the lap roll 4117 to the first folding roll 4180.

While the prior embodiment was described as having the knife roll 4116 and lap roll 4117 peripheral speeds being equal and different than, and particularly, faster than the peripheral speed of the first folding roll 4180 to effectuate overlapping adjacent sheets, other embodiments may allow for the overlap of adjacent sheets to occur between the knife roll 4116 and the lap roll 4117. In such a configuration, the peripheral speed of the knife roll 4116 will be greater than the peripheral speed of the lap roll 4117. Further, the peripheral speed of the lap roll 4117 will be substantially equal to the peripheral speed of the first folding roll 4180.

To switch between different modes, the machine would be reconfigured to switch the relative speeds between the rolls that effectuate the sheet overlap and to change the number of knife blades 4168 that are active. These change overs could be manual or automatic as discussed above for prior embodiments.

Further, the vacuum ports 4224, 4223, 4204 of the various web handling rolls in the folding machine 4100 could incorporate movable vacuum ports similar to those discussed above. Similarly, the knife roll 4116 could include the actuatable knife blades discussed above as well as the cam actuated anvil.

It should be noted that all of the prior disclosed embodiments disclose single path folding machines. As used herein, a single path folding machine shall be one where in a given operating mode, all of the sheets pass through all of the same nips between adjacent rolls and thus travel along a same sheet path. However, not all embodiments are limited to single path folding machines and some embodiments could utilize multiple webs of material that are cut into individual sheets.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A web handling roll arrangement comprising:

a roll body defining a roll body axis of rotation;

a movable vacuum port member carried by the roll body, the movable vacuum port member including a first vacuum port being configured to provide a vacuum for adhering a web of material to the roll body as the roll body rotates about the roll body axis of rotation, the movable vacuum port member being movable relative to the roll body to transition the first vacuum port between first and second positions relative to the roll body a vacuum supply manifold positioned within the roll body;

a vacuum supply valve arrangement interposed between the vacuum supply manifold and the movable vacuum port member; and wherein movement of the movable vacuum port member relative to the roll body transitions the vacuum supply valve between open and closed states.

2. The web handling roll arrangement of claim 1, wherein the vacuum supply valve includes first and second sliding surfaces that each have openings, when the openings fluidly communicate the vacuum supply valve is in the open state and when the openings do not fluidly communicate the vacuum supply valve is in the closed state.

3. A web handling roll arrangement comprising:

a roll body defining a roll body axis of rotation;

a movable vacuum port member carried by the roll body, the movable vacuum port member including a first vacuum port being configured to provide a vacuum for adhering a web of material to the roll body as the roll body rotates about the roll body axis of rotation, the movable vacuum port member being movable relative to the roll body to transition the first vacuum port between first and second positions relative to the roll body;

wherein:

when the movable vacuum port member moves to transition the first vacuum port between the first and second positions relative to the roll body, the first vacuum port passes through a third position having a different radial position than the first and second positions; and the third position is radially farther from the roll body axis of rotation than the first and second positions such that as the movable vacuum port member moves to transition the first vacuum port from the first position to the second position the first vacuum port first moves radially outward as the first vacuum port approaches the third position and then moves radially inward as the first vacuum port moves away from the third position to the second position.

4. A web handling roll arrangement comprising:

a roll body defining a roll body axis of rotation;

a movable vacuum port member carried by the roll body, the movable vacuum port member including a first vacuum port being configured to provide a vacuum for adhering a web of material to the roll body as the roll body rotates about the roll body axis of rotation, the movable vacuum port member being movable relative to the roll body to transition the first vacuum port between first and second positions relative to the roll body;

further comprising:

a second roll body defining a second roll body axis of rotation; and a third vacuum port;

wherein:

the first and second roll bodies defining a transfer nip therebetween proximate which, at a least a portion of, a web of material is transferred from the first roll body to the second roll body;

the web of material being transferred proximate the transfer nip from the first vacuum port to the third vacuum port; and the first roll body rotates with a first peripheral speed and the second roll body rotates with a second peripheral speed different than the first peripheral speed, wherein the first vacuum port moves relative to the first roll body during transfer of the web to reduce a difference in speed between the first vacuum port and the third vacuum port during transfer of the web from the first roll body to the second roll body.

5. The web handling roll arrangement of claim 4, wherein the first peripheral speed is greater than the second peripheral speed and the first vacuum port moves relative to the first roll body in an opposite direction as the first roll body during transfer of the web from the first vacuum port to the third vacuum port.

6. The web handling roll arrangement of claim 5, wherein the first and third vacuum ports have speeds that are within 5% of each other during transfer of the web from the first vacuum port to the third vacuum port.

7. The web handling roll arrangement of claim 4, wherein the first and second positions are at different radial locations relative to the roll body axis of rotation.

8. The web handling roll arrangement of claim 4, wherein the first and second positions are at different angular locations about the roll body axis of rotation.

9. The web handling roll arrangement of claim 4, wherein:

the movable vacuum port member is rotatably carried by the roll body for rotation about a movable vacuum port member axis of rotation relative to the roll body; and the roll handling body is configured to rotate about the roll body axis of rotation in a first angular direction and the movable vacuum port member is configured to rotate, at least in part, in a second angular direction about the movable vacuum port member axis of rotation that is opposite the first angular direction.

10. The web handling roll arrangement claim 4, further including:

a vacuum supply manifold positioned within the roll body;

a vacuum supply valve arrangement interposed between the vacuum supply manifold and the movable vacuum port member.

11. A web handling roll arrangement comprising:

a roll body defining a roll body axis of rotation;

a movable vacuum port member carried by the roll body, the movable vacuum port member including a first vacuum port being configured to provide a vacuum for adhering a web of material to the roll body as the roll body rotates about the roll body axis of rotation, the movable vacuum port member being movable relative to the roll body to transition the first vacuum port between first and second positions relative to the roll body;

further comprising:

a second roll body defining a second roll body axis of rotation; and a third vacuum port;

wherein:

the first and second roll bodies defining a transfer nip therebetween proximate which, at a least a portion of, a web of material is transferred from the first roll body to the second roll body;

the web of material being transferred proximate the transfer nip from the first vacuum port to the third vacuum port; and the second roll body carries a web handling component that protrudes radially beyond an outer surface of the second roll body proximate the third vacuum port and the first movable vacuum port member protrudes radially beyond an outer surface of the first roll body, wherein the first movable vacuum port member is moved during transfer of the web from the first vacuum port to the third vacuum port such that the first movable vacuum port member does not contact the web handling component.

12. The web handling roll arrangement of claim 11, wherein the first vacuum port holds a leading end of the web and transfers the leading end of the web to the third vacuum port, wherein the leading end of the web is positioned proximate the web handling component carried by the second roll body after transfer.

13. A method of transferring a sheet of a web of material from a first web handling roll to a second web handling roll, the method comprising:

driving a first roll body of the first web handling roll at a first peripheral speed;

driving a second roll body of the second web handling roll at a second peripheral speed different than the first peripheral speed creating a speed difference therebetween;

holding a leading end of a sheet of a web of material with a first vacuum port of the first web handling roll;

transferring the leading end of the sheet from the first vacuum port to a second vacuum port of the second web handling roll proximate a transfer nip formed between the first and second web handling rolls; and moving at least one of the first or second vacuum ports relative to the corresponding one of the first and second roll bodies while transferring the leading end of the sheet from the first vacuum port to the second vacuum port to reduce the speed difference.

14. The method of claim 13, wherein the step of moving the at least one of the first or second vacuum ports makes the speed difference zero.

15. A method of transferring a sheet of a web of material from a first web handling roll to a second web handling roll, the method comprising:

driving the first web handling roll at a first peripheral speed;

driving the second web handling roll at a second peripheral speed different than the first peripheral speed creating a speed difference therebetween;

holding a leading end of a sheet of a web of material with a movable vacuum port of a movable vacuum port member carried by a first roll body of the first web handling roll;

transferring the leading end of the sheet from the movable vacuum port to a second vacuum port that is part of the second web handling roll proximate a transfer nip formed between the first and second web handling rolls; and moving the movable vacuum port member relative to the first roll body while transferring the leading end of the sheet from the movable vacuum port to the second vacuum port to reduce the speed difference between the first and second web handling rolls while the leading end of the sheet is transferred therebetween.

16. The method of claim 15, wherein moving the movable vacuum port member also controls turning on and off vacuum.

* * * * *